US011181328B2

(12) United States Patent
Satou et al.

(10) Patent No.: US 11,181,328 B2
(45) Date of Patent: Nov. 23, 2021

(54) HEAT EXCHANGER AND AIR CONDITIONER

(71) Applicant: DAIKIN INDUSTRIES, LTD., Osaka (JP)

(72) Inventors: Ken Satou, Osaka (JP); Tomohiko Sakamaki, Osaka (JP); Kouju Yamada, Osaka (JP); Masanori Jindou, Osaka (JP); Tomoya Yamaguchi, Osaka (JP); Satoshi Inoue, Osaka (JP); Shun Yoshioka, Osaka (JP); Yoshio Oritani, Osaka (JP); Hiroaki Matsuda, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/497,662

(22) PCT Filed: Mar. 27, 2018

(86) PCT No.: PCT/JP2018/012471
§ 371 (c)(1),
(2) Date: Sep. 25, 2019

(87) PCT Pub. No.: WO2018/181338
PCT Pub. Date: Oct. 4, 2018

(65) Prior Publication Data

US 2020/0109902 A1 Apr. 9, 2020

(30) Foreign Application Priority Data

Mar. 27, 2017 (JP) ..... JP2017-060764
Sep. 29, 2017 (JP) ..... JP2017-190278
Feb. 20, 2018 (JP) ..... JP2018-027785

(51) Int. Cl.
*F28F 1/02* (2006.01)
*F28D 1/02* (2006.01)
(Continued)

(52) U.S. Cl.
CPC ..... *F28F 1/022* (2013.01); *F28D 1/0233* (2013.01); *F28D 1/0535* (2013.01);
(Continued)

(58) Field of Classification Search
CPC ..... F28F 9/0202–9/0217; F28F 9/028; F28D 1/0535; F28D 1/05325; F28D 1/05333;
(Continued)

(56) References Cited

U.S. PATENT DOCUMENTS 5,203,407 A * 4/1993 Nagasaka ..... F28D 1/05375 165/174
5,582,239 A * 12/1996 Tsunoda ..... B21D 53/02 165/176
(Continued)

FOREIGN PATENT DOCUMENTS

DE 102012110701 A1 * 5/2014 ..... F28F 27/02
JP 11337293 A * 12/1999 ..... F28F 9/0212
(Continued)

OTHER PUBLICATIONS

JP 11-337293 English Machine Translation (Year: 1999).*
(Continued)

*Primary Examiner* — Len Tran
*Assistant Examiner* — Jenna M Hopkins
(74) *Attorney, Agent, or Firm* — Osha Bergman Watanabe & Burton LLP

(57) ABSTRACT

A heat exchanger including: a header; flat tubes connected to the header and disposed in line along a longitudinal direction of the header; a first partition that partitions an inner space of the header into a first space on a side where the flat tubes
(Continued)

are connected and a second space on a side opposite to the first space; and a second partition that partitions the inner space of the header into a first side and a second side. The first side is one side of the header in the longitudinal direction and the second side is opposite to the first side. The first partition has a common opening. The common opening includes an insertion opening and a refrigerant opening. A refrigerant moves between the first space and the second space via the refrigerant opening. The second partition is inserted into the insertion opening.

13 Claims, 23 Drawing Sheets

(51) Int. Cl.
*F28D 1/053* (2006.01)
*F28F 9/02* (2006.01)

(52) U.S. Cl.
CPC ..... *F28D 1/05325* (2013.01); *F28D 1/05333* (2013.01); *F28D 1/05341* (2013.01); *F28D 1/05366* (2013.01); *F28D 1/05375* (2013.01); *F28D 1/05383* (2013.01); *F28F 9/02* (2013.01); *F28F 9/0202* (2013.01); *F28F 9/0204* (2013.01); *F28F 9/0207* (2013.01); *F28F 9/0209* (2013.01); *F28F 9/0212* (2013.01); *F28F 9/0214* (2013.01); *F28F 9/0217* (2013.01)

(58) Field of Classification Search
CPC ..... F28D 1/05341; F28D 1/05375; F28D 1/05383
USPC ..... 165/173, 174
See application file for complete search history.

(56) References Cited

U.S. PATENT DOCUMENTS 6,082,447 A * 7/2000 Insalaco ..... F28F 9/0212 165/174
9,448,016 B2 * 9/2016 Wang ..... F28F 9/0212
9,791,213 B2 10/2017 Yoshioka et al.
10,465,955 B2 * 11/2019 Inoue ..... F24F 1/18
10,563,890 B2 * 2/2020 Sharma ..... F28D 1/05391
2006/0254659 A1 * 11/2006 Bellott ..... F25B 39/04 138/89
2007/0044953 A1 * 3/2007 Hu ..... F28D 1/0443 165/287
2007/0062215 A1 * 3/2007 Yamazaki ..... F28D 1/05366 62/509
2010/0206535 A1 * 8/2010 Munoz ..... F25B 39/028 165/173
2010/0314090 A1 12/2010 Moriya et al.
2012/0111547 A1 * 5/2012 Suzuki ..... F25B 39/04 165/173
2013/0126140 A1 * 5/2013 Park ..... F28F 9/0273 165/173
2013/0160981 A1 * 6/2013 Wang ..... F28F 9/0212 165/178
2014/0014296 A1 * 1/2014 Arino ..... F28F 27/02 165/96
2014/0069610 A1 * 3/2014 Arino ..... F28F 9/0243 165/71
2014/0311702 A1 * 10/2014 Takagi ..... F25B 39/028 165/41
2014/0338874 A1 * 11/2014 Jindou ..... F28F 9/0204 165/173
2015/0021003 A1 * 1/2015 Cho ..... F28F 9/0212 165/145
2015/0083377 A1 * 3/2015 Jindou ..... F28D 1/05375 165/143
2015/0114030 A1 * 4/2015 Park ..... F28F 9/0212 62/507
2015/0251517 A1 * 9/2015 Heyl ..... F25B 39/00 165/62
2015/0345843 A1 * 12/2015 Voorhis ..... F28F 9/026 62/504
2016/0327317 A1 11/2016 Inoue et al.
2016/0363392 A1 * 12/2016 Winterstten ..... F28F 9/0217

FOREIGN PATENT DOCUMENTS

JP 2013137193 A * 7/2013 ..... F28F 9/028
JP 2015-068622 A 4/2015
JP 2015-127618 A 7/2015
JP 5741680 B1 * 7/2015 ..... F28D 1/05391
JP 2016-070622 A 5/2016
JP 2016-125748 A 7/2016
JP 2016133262 A * 7/2016 ..... F25B 41/00
JP 2017058071 A * 3/2017 ..... F28F 9/028
WO 2012/132924 A1 10/2012
WO WO-2013161311 A1 * 10/2013 ..... F28F 9/0204
WO WO-2014188714 A1 * 11/2014 ..... F25B 39/028
WO WO-2014197960 A1 * 12/2014 ..... F28F 9/0282
WO WO-2015045564 A1 * 4/2015 ..... F28F 9/0202
WO 2015/098859 A1 7/2015
WO WO-2015098860 A1 * 7/2015 ..... F28F 9/028
WO WO-2015180661 A1 * 12/2015 ..... F28D 1/05366
WO WO-2016052304 A1 * 4/2016 ..... F28F 9/02
WO WO-2016060064 A1 * 4/2016 ..... F25B 13/00
WO WO-2016060078 A1 * 4/2016 ..... F28F 9/02
WO WO-2016117412 A1 * 7/2016 ..... F25B 39/00

OTHER PUBLICATIONS

International Preliminary Report on Patentability issued in corresponding International Patent Application No. PCT/JP2018/012471, dated Oct. 1, 2019 (4 pages).
Notification of Transmittal of Copies of Translation of the International Preliminary Report on Patentability issued in corresponding International Application No. PCT/JP2018/012471, dated Oct. 10, 2019 (1 page).
International Search Report issued in corresponding International Application No. PCT/JP2018/012471 dated Jun. 19, 2018 (3 pages).
Office Action issued in the U.S. Appl. No. 16/497,604 dated Nov. 13, 2020 (20 pages).

* cited by examiner

HEAT EXCHANGER AND AIR CONDITIONER

TECHNICAL FIELD

The present invention relates to a heat exchanger and an air conditioner.

BACKGROUND

A known heat exchanger has a plurality of flat tubes, a fin joined to the plurality of flat tubes, and a header connected to ends of the plurality of flat tubes. This heat exchanger is designed to enable heat exchange between a refrigerant that flows through the flat tubes and air that flows outside the flat tubes.

For example, Patent Literature 1 (JP 2016-125748 A) proposes a heat exchanger that employs a horizontally extending partitioning member to partition an inner space of the header into an upper space and a lower space, making it possible to supply the refrigerant divided for a plurality of flat tubes connected at the individual levels of height.

The heat exchanger described in Patent Literature 1 has a vertically extending partition plate that partitions the inside of the header into a space on the side closer to the flat multi-hole tubes and an opposite space, and this partition plate has formed therein an insertion slot for fixing the partitioning member for vertically partitioning the inner space of the header, and an opening through which the refrigerant can flow between such flat tube-side space and the opposite space, which are however formed as separate openings juxtaposed in the longitudinal direction of the header.

It has therefore been difficult to highly integrate the flat tubes in the longitudinal direction of the header, and to downsize the header.

PATENT LITERATURE

[Patent Literature 1] JP 2016-125748 A

SUMMARY

One or more embodiments of the present invention provide a heat exchanger and an air conditioner, capable of highly integrating the flat tubes in the longitudinal direction of the header, or of downsizing the header in the longitudinal direction.

A heat exchanger according to one or more embodiments has a header, a plurality of flat tubes, a first partitioning member (a first partition), and a second partitioning member (a second partition). The plurality of flat tubes is arranged in line along a longitudinal direction of the header, and is connected to the header. The first partitioning member partitions an inner space of the header into a flat tube-side space (a first space) on a side the plurality of flat tubes is connected, and an opposite-flat tube-side space (second space) on a side opposite to the flat tube-side space. The second partitioning member partitions the inner space of the header into a first side and a second side. The first side is one side of the longitudinal direction of the header. The second side is opposite to the first side. The first partitioning member has a common opening that includes an insertion opening portion (an insertion opening) and a refrigerant opening portion (a refrigerant opening). The refrigerant opening portion allows a refrigerant to move therethrough between the flat tube-side space and the opposite-flat tube-side space. The second partitioning member is inserted into the insertion opening portion.

The common opening may be an integrated opening without any separate portions. The first partitioning member, when provided with a plurality of openings, need not always have all of these openings combined into a common opening. If the openings are given as the common opening at least in some part, such part may contribute to higher integration and downsizing.

Here, the flat tube is not limited, and may typically be any of those having a plurality of flow channels formed therein so as to be juxtaposed in the longitudinal direction of cross section of the flow channels.

The second partitioning member is not limited so long as it can partition the inner space of the header in the longitudinal direction of the header, into the first side and the second side, and may be of a flat plate shape, or may have a specific face and a face inclined therefrom.

In the heat exchanger, the second partitioning member that partitions the inner space of the header in the longitudinal direction of the header into the first side and the second side is inserted into the insertion opening portion. The first partitioning member has formed therein the common opening that contains both of such insertion opening portion, and the refrigerant opening portion through which a refrigerant can move between the flat tube-side space and the opposite-flat tube-side space. This enables higher integration of the flat tubes in the longitudinal direction of the header, and the downsizing of the header in the longitudinal direction.

In a heat exchanger according to one or more embodiments, the common opening of the first partitioning member has an outline conforming to a shape capable of positioning the second partitioning member across the longitudinal direction of the header.

Now, the shape capable of positioning the second partitioning member, contained in the outline of the common opening is not limited, and may typically be a shape conforming to a part of the outline of the second partitioning member, or may be a shape which enables holding of at least a part of the second partitioning member from the first side and the second side. Such shape may, for example, be given by an outline of the common opening having a projection that protrudes towards the inner side of the common opening, at a position other than both ends across the longitudinal direction of the header, wherein such projection may be a pair of projections that form portions, approaching each other, of the outline of the common opening. An opening portion between such pair of projections, in the common opening, may compose the refrigerant opening portion.

Such heat exchanger makes it possible to position the second partitioning member across the longitudinal direction of the header, with the aid of the common opening of the first partitioning member.

In a heat exchanger according to one or more embodiments, the second partitioning member has a first side member and a second side member. The first side member partitions the inner space of the header across the longitudinal direction of the header into the first side relative to the first side member and the second side relative to the first side member, and is positioned on the first side of the refrigerant opening portion. The second side member partitions the inner space of the header across the longitudinal direction of the header into the first side relative to the second side member and the second side relative to the second side member, and is positioned on the second side of the refrigerant opening portion. The common opening of the first partitioning member has the refrigerant opening portion; and a first side insertion opening portion and a second side insertion opening portion which serve as the insertion opening portion. The first side member is inserted into the first side insertion opening portion (a first side insertion opening). The second side member is inserted into the second side insertion opening portion (a second side insertion opening).

Such heat exchanger, making the common opening contain the first side insertion opening portion for insertion of the first side member, the second side insertion opening portion for insertion of the second side member, and the refrigerant opening portion, enables still higher integration of the flat tubes in the longitudinal direction of the header, and downsizing of the header in the longitudinal direction, even if the second partitioning member is composed of the first side member and the second side member, which are a plurality of separate members.

In a heat exchanger according to one or more embodiments, the flat tubes are not connected to a space in the inner space of the header, which is surrounded by the first side member and the second side member while placing the refrigerant opening portion in between.

Assuming now that the flat tubes are connected to the space in the inner space of the header, which is surrounded by the first side member and the second side member while placing the refrigerant opening portion in between, the refrigerant would tend to rush into the flat tubes, causing drift of the refrigerant. In contrast, this heat exchanger, having no flat tube connected to the space surrounded by the first side member and the second side member, can reduce the drift of the refrigerant.

In a heat exchanger according to one or more embodiments, the first side member has a nozzle in the flat tube-side space or in the opposite-flat tube-side space. The nozzle extends through the first side member, in the longitudinal direction of the header.

Being provided with the nozzle in the flat tube-side space or in the opposite-flat tube-side space of the first side member, such heat exchanger can allow enough refrigerant, fed to the second side of the first side member, to flow through the nozzle to reach the first side.

A heat exchanger according to one or more embodiments further includes a refrigerant pipe that is connected to the opposite-flat tube-side space in a space surrounded by the first side member and the second side member, in the inner space of the header. The first side member has the nozzle that extends therethrough in the longitudinal direction of the header, in the flat tube-side space.

Such heat exchanger can allow the refrigerant, fed to the opposite-flat tube-side space on the second side of the first side member, to flow through the nozzle provided to the flat tube-side space and to fully reach the first side of the flat tube-side space.

In a heat exchanger according to one or more embodiments, the first partitioning member has a first circulation opening portion and a second circulation opening portion. The first circulation opening portion connects the flat tube-side space and the opposite-flat tube-side space, on the first side of the first side member in the longitudinal direction of the header. The second circulation opening portion connects the flat tube-side space and the opposite-flat tube-side space, on the first side of the first circulation opening portion in the longitudinal direction of the header. The common opening of the first partitioning member has the refrigerant opening portion, the first side insertion opening portion, the second side insertion opening portion, and the first circulation opening portion.

Since the first partitioning member is provided with the first circulation opening portion and the second circulation opening portion, on the first side of the first side member in the longitudinal direction of the header, such heat exchanger can circulate the refrigerant in a space of the inner space of the header, particularly on the first side of the first side member in the longitudinal direction of the header. Even in such case where the refrigerant may be circulated inside the header, the flat tubes may be highly integrated in the longitudinal direction of the header, and the header may be downsized in the longitudinal direction of the header, since the common opening is composed of the refrigerant opening portion, the first side insertion opening portion, the second side insertion opening portion, and the first circulation opening portion.

In a heat exchanger according to one or more embodiments, the first partitioning member has a first circulation opening portion and a second circulation opening portion. The first circulation opening portion connects the flat tube-side space and the opposite-flat tube-side space, on the first side of the first side member in the longitudinal direction of the header. The second circulation opening portion connects the flat tube-side space and the opposite-flat tube-side space, on the first side of the first circulation opening portion in the longitudinal direction of the header. Structures each having a set of the first circulation opening portion, the second circulation opening portion, the refrigerant opening portion, the first side insertion opening portion, the second side insertion opening portion, the first side member, and the second side member, are repeatedly juxtaposed in the longitudinal direction of the header. The common opening of the first partitioning member has the refrigerant opening portion, the first side insertion opening portion, and the second side insertion opening portion that belong to a same set; and the second circulation opening portion that belongs to another set positioned on the second side of the one set.

Since the first partitioning member is provided with the first circulation opening portion and the second circulation opening portion, on the first side of the first side member in the longitudinal direction of the header, such heat exchanger can circulate the refrigerant in a space of the inner space of the header, particularly on the first side of the first side member in the longitudinal direction of the header. Since the structures each having a set of the first circulation opening portion, the second circulation opening portion, the refrigerant opening portion, the first side insertion opening portion, the second side insertion opening portion, the first side member, and the second side member, are repeatedly juxtaposed in the longitudinal direction of the header, the refrigerant can circulate at a plurality of sites inside the header. Even in such case where the refrigerant can be circulated at a plurality of sites inside the header, enabled are higher integration of the flat tubes in the longitudinal direction of the header, and downsizing of the header in the longitudinal direction, since the common opening is composed of the refrigerant opening portion, the first side insertion opening portion, and the second side insertion opening portion that belong to the same set, and the second circulation opening portion that belongs to another set positioned on the second side of the one set.

In a heat exchanger according to one or more embodiments, the first partitioning member has a first circulation opening portion and a second circulation opening portion. The first circulation opening portion connects the flat tube-side space and the opposite-flat tube-side space, on the first side of the first side member in the longitudinal direction of the header. The second circulation opening portion connects the flat tube-side space and the opposite-flat tube-side space, on the first side of the first circulation opening portion in the longitudinal direction of the header. Structures each having a set of the first circulation opening portion, the second circulation opening portion, the refrigerant opening portion, the first side insertion opening portion, the second side insertion opening portion, the first side member, and the second side member, are repeatedly juxtaposed in the longitudinal direction of the header. The common opening of the first partitioning member has the refrigerant opening portion, the first side insertion opening portion, the second side insertion opening portion, and the first circulation opening portion that belong to a same set; and the second circulation opening portion that belongs to another set positioned on the second side of the one set.

Since the first partitioning member is provided with the first circulation opening portion and the second circulation opening portion, on the first side of the first side member in the longitudinal direction of the header, such heat exchanger can circulate the refrigerant in a space of the inner space of the header, particularly on the first side of the first side member in the longitudinal direction of the header. Since the structures each having a set of the first circulation opening portion, the second circulation opening portion, the refrigerant opening portion, the first side insertion opening portion, the second side insertion opening portion, the first side member, and the second side member, are repeatedly juxtaposed in the longitudinal direction of the header, the refrigerant can circulate at a plurality of sites inside the header. Even in such case where the refrigerant can be circulated at a plurality of sites inside the header, enabled are higher integration of the flat tubes in the longitudinal direction of the header, and downsizing of the header in the longitudinal direction, since the common opening is composed of the refrigerant opening portion, the first side insertion opening portion, the second side insertion opening portion, and the first circulation opening portion that belong to the same set, and the second circulation opening portion that belongs to another set positioned on the second side of the one set.

In a heat exchanger according to one or more embodiments, the second circulation opening portion has an aperture area larger than an aperture area of the first circulation opening portion.

Since the heat exchanger has the second circulation opening portion made wider than the first circulation opening portion, the refrigerant can easily flow through the second circulation opening portion, even when the refrigerant ejected through the nozzle is fed more abundantly to a part on the first side in a space on the first side of the first side member. It now becomes possible to avoid the refrigerant from being locally concentrated.

In a heat exchanger according to one or more embodiments, the nozzle of the first side member is disposed at a position which does not overlap a virtual space defined by extending the first circulation opening portion in a direction the flat tubes extend, when viewed in the longitudinal direction of the header.

Such heat exchanger can suppress the refrigerant having passed through the first circulation opening portion from colliding with the refrigerant having passed through the nozzle of the first side member, so that the refrigerant having passed through the nozzle of the first side member can be brought to the first side more efficiently.

In a heat exchanger according to one or more embodiments, the nozzle of the first side member is disposed 1 mm or more away from an inner circumferential face of the header and away from the first partitioning member.

Such heat exchanger can avoid the nozzle of the first side member from being buried with a brazing filler material, even when the heat exchanger is manufactured by brazing and fixing the individual members with each other. In particular in the heat exchanger according to one or more embodiments, with the nozzle of the first side member disposed 1 mm or more away from the inner circumferential face of the header and from the first partitioning member, the nozzle is now successfully avoided from being buried with the brazing filler material, even if the nozzle is disposed so as to suppress collision of the refrigerant having passed through the first circulation opening portion, with the refrigerant having passed through the nozzle of the first side member.

In a heat exchanger according to one or more embodiments, the longitudinal direction of the header lies in a vertical direction.

Such heat exchanger enables high integration of the flat tubes, or downsizing, in the vertical direction.

An air conditioner according to one or more embodiments includes the heat exchanger according to the embodiments described above.

Such air conditioner can improve air conditioning performance or downsize the air conditioner, through higher integration of the flat tubes of the heat exchanger or downsizing of the heat exchanger.

DETAILED DESCRIPTION

An air conditioner according to one or more embodiments of the present invention that employs an outdoor heat exchanger as a heat exchanger and relevant Modified Examples will be explained below with reference to the attached drawings.

(1) STRUCTURE OF AIR CONDITIONER

Figure 1:
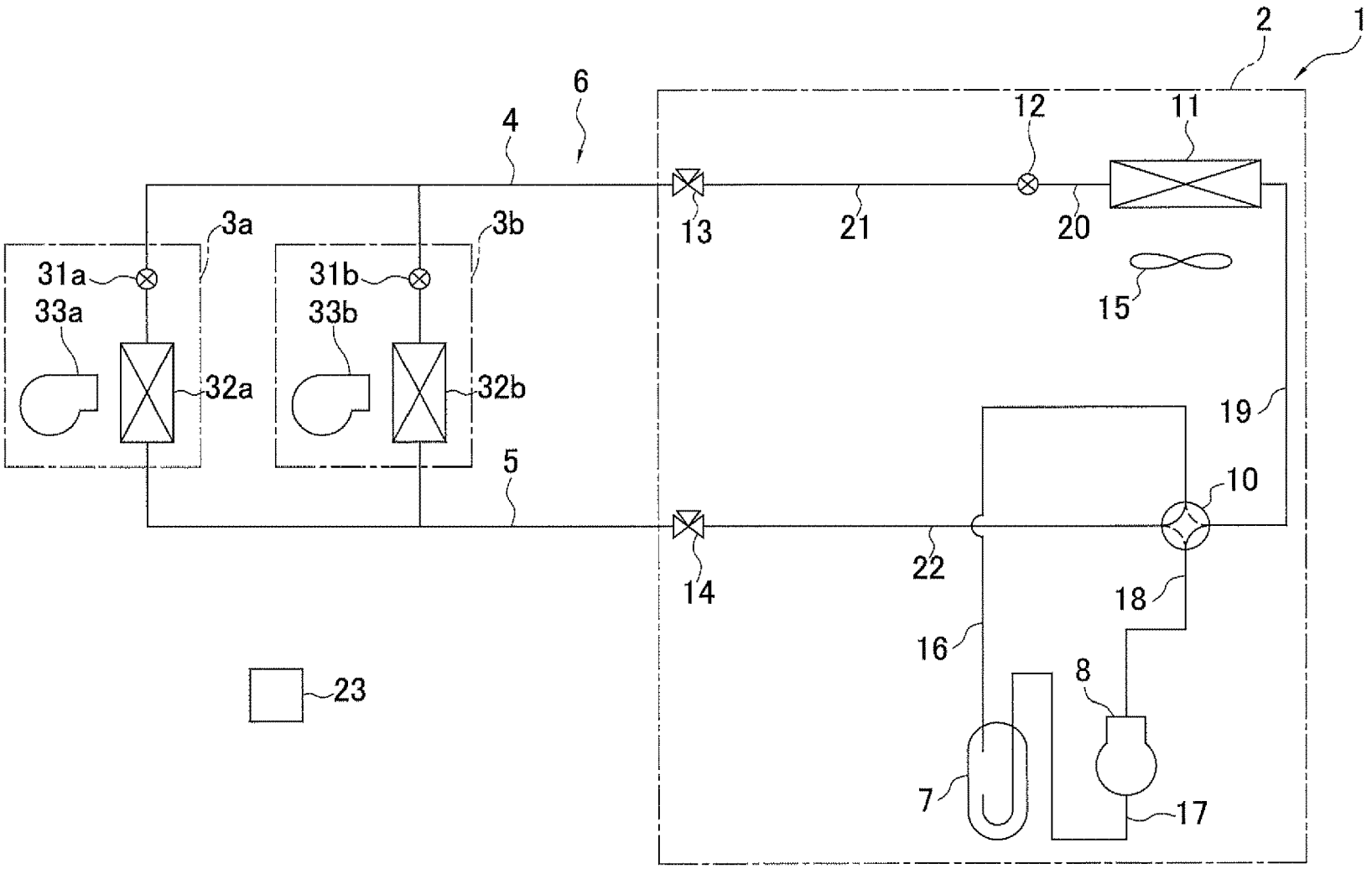
FIG. 1 is a schematic structure diagram of an air conditioner that employs a heat exchanger according to one or more embodiments of the present invention.

FIG. 1 is a schematic structure diagram of an air conditioner 1 according to one or more embodiments of the present invention, employing an outdoor heat exchanger 11 as a heat exchanger.

The air conditioner 1 is an apparatus capable of indoor cooling and heating of buildings and so forth, by running a vapor compression refrigeration cycle. The air conditioner 1 mainly has an outdoor unit 2; indoor units 3*a*, 3*b*; a liquid-refrigerant connection pipe 4 and a gas-refrigerant connection pipe 5 that connect the outdoor unit 2 and the indoor units 3*a*, 3*b*; and a control unit 23 that controls component equipment of the outdoor unit 2 and the indoor units 3*a*, 3*b*. A vapor compression-type refrigerant circuit 6 of the air conditioner 1 is constructed by connecting the outdoor unit 2 and the indoor units 3*a*, 3*b* through the refrigerant connection pipes 4, 5.

The outdoor unit 2 is installed outdoors (on building roofs or at around wall surfaces of building), and composes a part of the refrigerant circuit 6. The outdoor unit 2 mainly has an accumulator 7, a compressor 8, a four-way switching valve 10, an outdoor heat exchanger 11, an outdoor expansion valve 12 as an expansion mechanism, a liquid-side shutoff valve 13, a gas-side shutoff valve 14, and an outdoor fan 15. The individual equipment and valves are connected through refrigerant pipes 16 to 22.

The indoor units 3*a*, 3*b* are installed indoors (living room, ceiling space, etc.), and composes a part of the refrigerant circuit 6. The indoor unit 3*a* mainly has an indoor expansion valve 31*a*, an indoor heat exchanger 32*a*, and an indoor fan 33*a*. The indoor unit 3*b* mainly has an indoor expansion valve 31*b* as an expansion mechanism, an indoor heat exchanger 32*b*, and an indoor fan 33*b*.

The refrigerant connection pipes 4, 5 are installed on site, when the air conditioner 1 is installed at an installation site of building. One end of the liquid-refrigerant connection pipe 4 is connected to the liquid-side shutoff valve 13 of the outdoor unit 2, and the other end of the liquid-refrigerant connection pipe 4 is connected to liquid side ends of the indoor expansion valves 31*a*, 31*b* of the indoor units 3*a*, 3*b*. One end of the gas-refrigerant connection pipe 5 is connected to the gas-side shutoff valve 14 of the outdoor unit 2, and the other end of the gas-refrigerant connection pipe 5 is connected to gas-side ends of the indoor heat exchangers 32*a*, 32*b* of the indoor units 3*a*, 3*b*.

The control unit 23 is constructed by control boards (not illustrated) provided to the outdoor unit 2 and the indoor units 3*a*, 3*b*, connected by communication. Note that the outdoor unit 2 and the indoor units 3*a*, 3*b* in FIG. 1 are illustrated as being apart from each other for convenience. The control unit 23 is designed to control the component equipment 8, 10, 12, 15, 31*a*, 31*b*, 33*a*, 33*b* of the air conditioner 1 (the outdoor unit 2 and the indoor units 3*a*, 3*b*, herein), that is, to be responsible for overall control of the air conditioner 1.

(2) OPERATIONS OF AIR CONDITIONER

Next, operations of the air conditioner 1 will be explained referring to FIG. 1. The air conditioner 1 performs cooling operation allowing a refrigerant to flow through the compressor 8, the outdoor heat exchanger 11, the outdoor expansion valve 12 as well as the indoor expansion valves 31*a*, 31*b*, and the indoor heat exchangers 32*a*, 32*b* in that order; and heating operation allowing the refrigerant to flow through the compressor 8, the indoor heat exchangers 32*a*, 32*b*, the indoor expansion valves 31*a*, 31*b* as well as the outdoor expansion valve 12, and the outdoor heat exchanger 11 in that order. The cooling operation and the heating operation are performed by the control unit 23.

In the cooling operation, the four-way switching valve 10 is switched into outdoor radiation mode (indicated by solid lines in FIG. 1). In the refrigerant circuit 6, low pressure gas refrigerant in the refrigeration cycle is sucked by the compressor 8, compressed to a high pressure level for the refrigeration cycle, and is then discharged. The high pressure gas refrigerant discharged from the compressor 8 is fed through the four-way switching valve 10 to the outdoor heat exchanger 11. The high pressure gas refrigerant fed to the outdoor heat exchanger 11 is subjected, in such outdoor heat exchanger 11 that functions as a radiator for the refrigerant, to heat exchange with outdoor air which is fed as a cooling source by the outdoor fan 15 so as to radiate heat, and is converted into high pressure liquid refrigerant. The high pressure liquid refrigerant that radiated heat in the outdoor heat exchanger 11 is fed through the outdoor expansion valve 12, the liquid-side shutoff valve 13, and the liquid-refrigerant connection pipe 4, to the indoor expansion valves 31*a*, 31*b*. The refrigerant fed to the indoor expansion valves 31*a*, 31*b* is decompressed by the indoor expansion valves 31*a*, 31*b* down to a low pressure level for the refrigeration cycle, to be converted into low pressure refrigerant in gas-liquid two-phase state. The low pressure refrigerant in gas-liquid two-phase state decompressed in the indoor expansion valves 31*a*, 31*b* is fed to the indoor heat exchangers 32*a*, 32*b*. The low pressure refrigerant in gas-liquid two-phase state, fed to the indoor heat exchangers 32*a*, 32*b*, is then subjected in the indoor heat exchangers 32*a*, 32*b* to heat exchange with indoor air that is fed as a heating source by the indoor fans 33*a*, 33*b*, and evaporates. The indoor air is thus cooled, and then fed indoors for indoor cooling. The low pressure gas refrigerant evaporated in the indoor heat exchangers 32*a*, 32*b* is again sucked by the compressor 8, after being routed through the gas-refrigerant connection pipe 5, the gas-side shutoff valve 14, the four-way switching valve 10, and the accumulator 7.

In the heating operation, the four-way switching valve 10 is switched into outdoor evaporation mode (indicated by broken lines in FIG. 1). In the refrigerant circuit 6, low pressure gas refrigerant in the refrigeration cycle is sucked by the compressor 8, compressed to a high pressure level for the refrigeration cycle, and is then discharged. The high pressure gas refrigerant discharged from the compressor 8 is fed through the four-way switching valve 10, the gas-side shutoff valve 14 and the gas-refrigerant connection pipe 5 to the indoor heat exchangers 32*a*, 32*b*. The high pressure gas refrigerant fed to the indoor heat exchangers 32*a*, 32*b* is subjected, in such indoor heat exchangers 32*a*, 32*b*, to heat exchange with indoor air which is fed as a cooling source by the indoor fans 33*a*, 33*b* so as to radiate heat, and is converted into high pressure liquid refrigerant. The indoor air is thus heated, and then fed indoors for indoor heating. The high pressure liquid refrigerant that radiated heat in the indoor heat exchangers 32*a*, 32*b* is fed through the indoor expansion valves 31*a*, 31*b*, the liquid-refrigerant connection pipe 4, and the liquid-side shutoff valve 13, to the outdoor expansion valve 12. The refrigerant fed to the outdoor expansion valve 12 is decompressed by the outdoor expansion valve 12 down to a low pressure level for the refrigeration cycle, to be converted into low pressure refrigerant in gas-liquid two-phase state. The low pressure refrigerant in gas-liquid two-phase state decompressed in the outdoor expansion valve 12 is fed to the outdoor heat exchanger 11. The low pressure refrigerant in gas-liquid two-phase state, fed to the outdoor heat exchanger 11, is then subjected in the outdoor heat exchanger 11 functioning as an evaporator of refrigerant to heat exchange with outdoor air that is fed as a heating source by the outdoor fan 15, then evaporated to be converted into low pressure gas refrigerant. The low pressure refrigerant evaporated in the outdoor heat exchanger 11 is again sucked by the compressor 8, after being routed through the four-way switching valve 10 and the accumulator 7.

(3) STRUCTURE OF OUTDOOR UNIT

Figure 2:
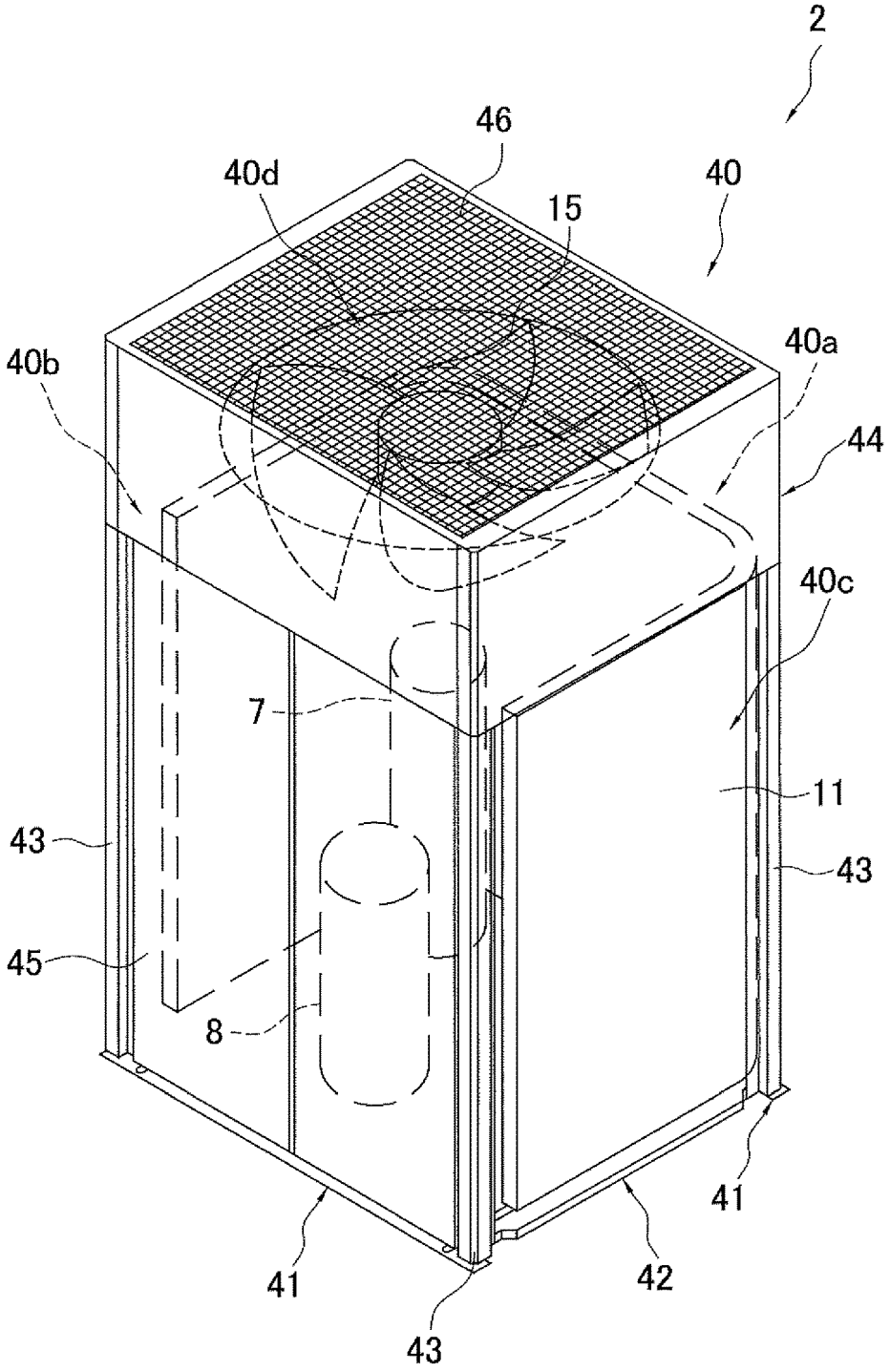
FIG. 2 is an external perspective view of an outdoor unit.
Figure 3:
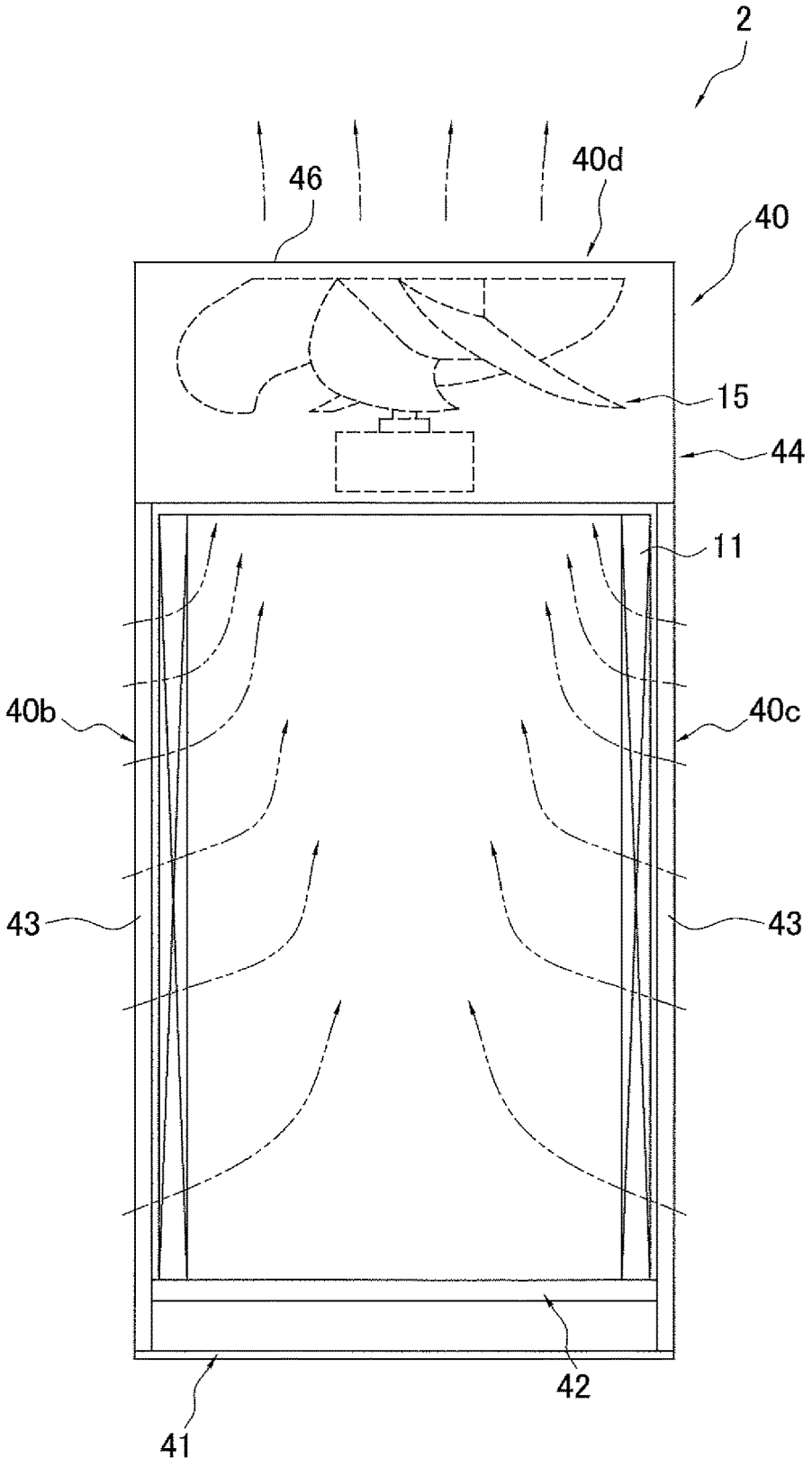
FIG. 3 is a front elevation of the outdoor unit (illustrated excluding refrigerant circuit components other than an outdoor heat exchanger).
Figure 4:
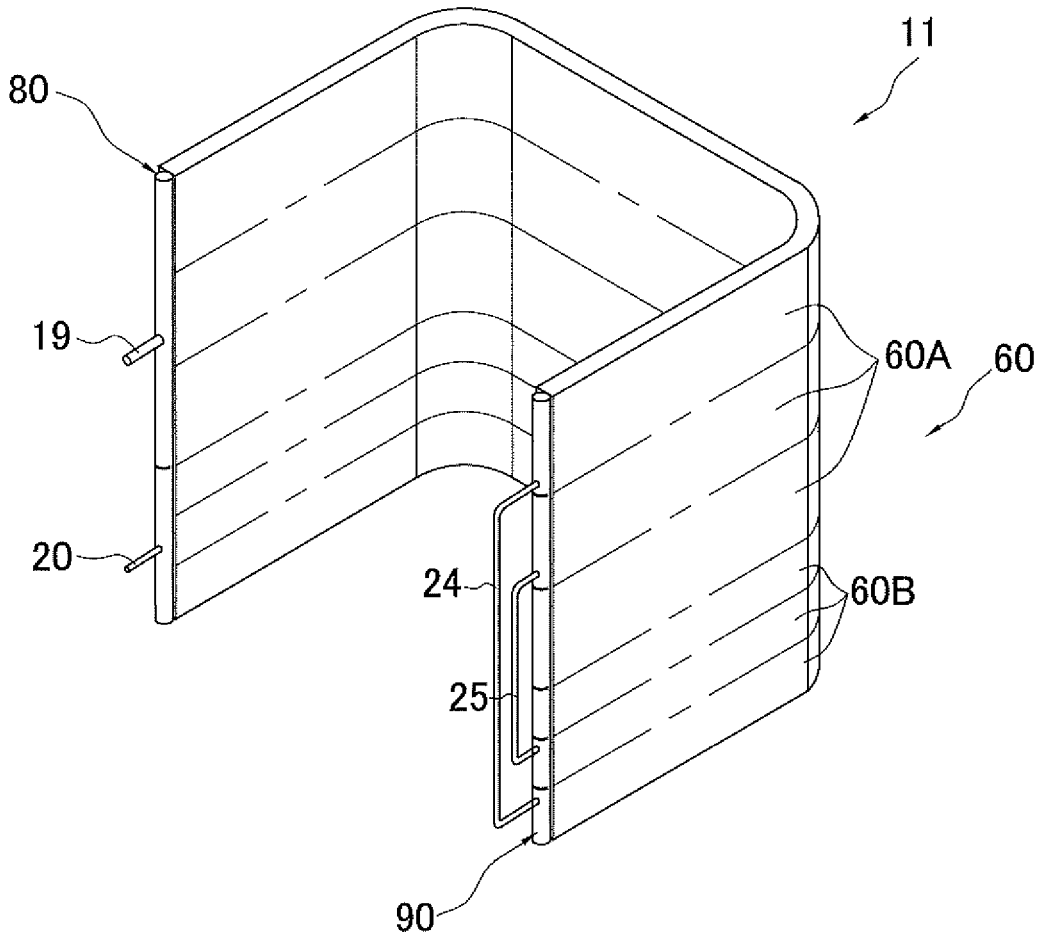
FIG. 4 is a schematic perspective view of the outdoor heat exchanger.
Figure 5:
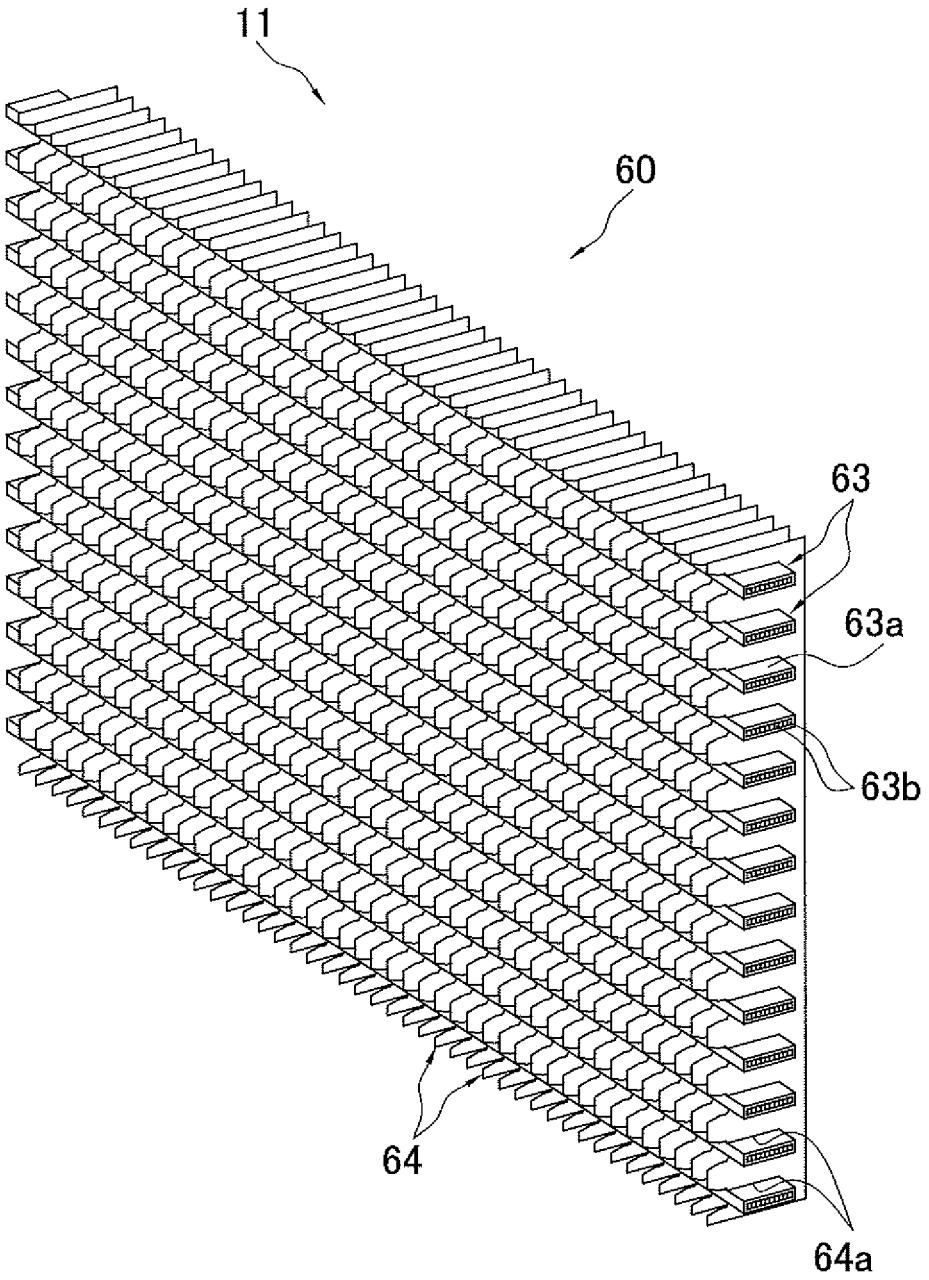
FIG. 5 is a partial enlarged view of a heat exchanging unit illustrated in FIG. 4.
Figure 6:
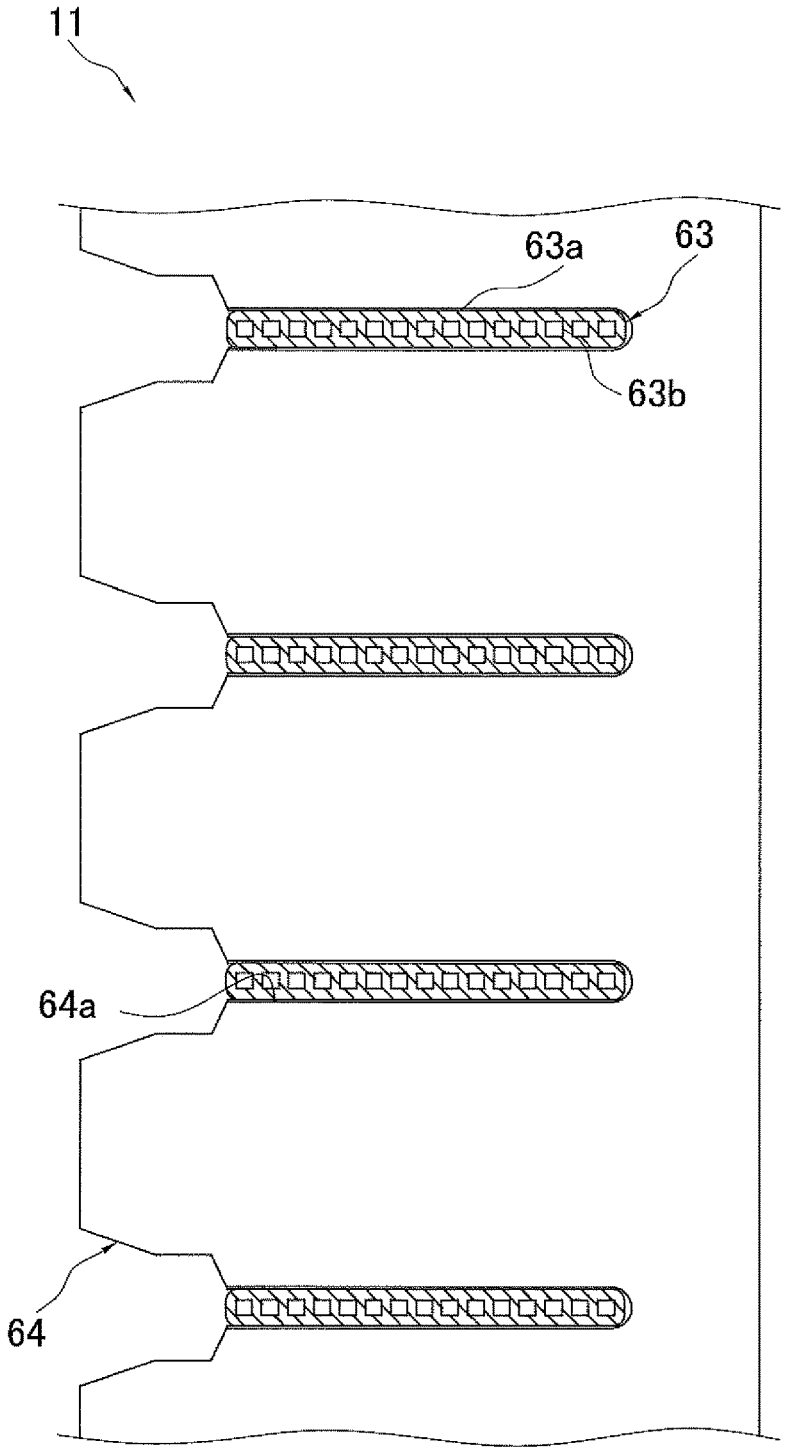
FIG. 6 is a schematic drawing illustrating a state of attachment of heat transfer fins to flat multi-hole tubes.
Figure 7:
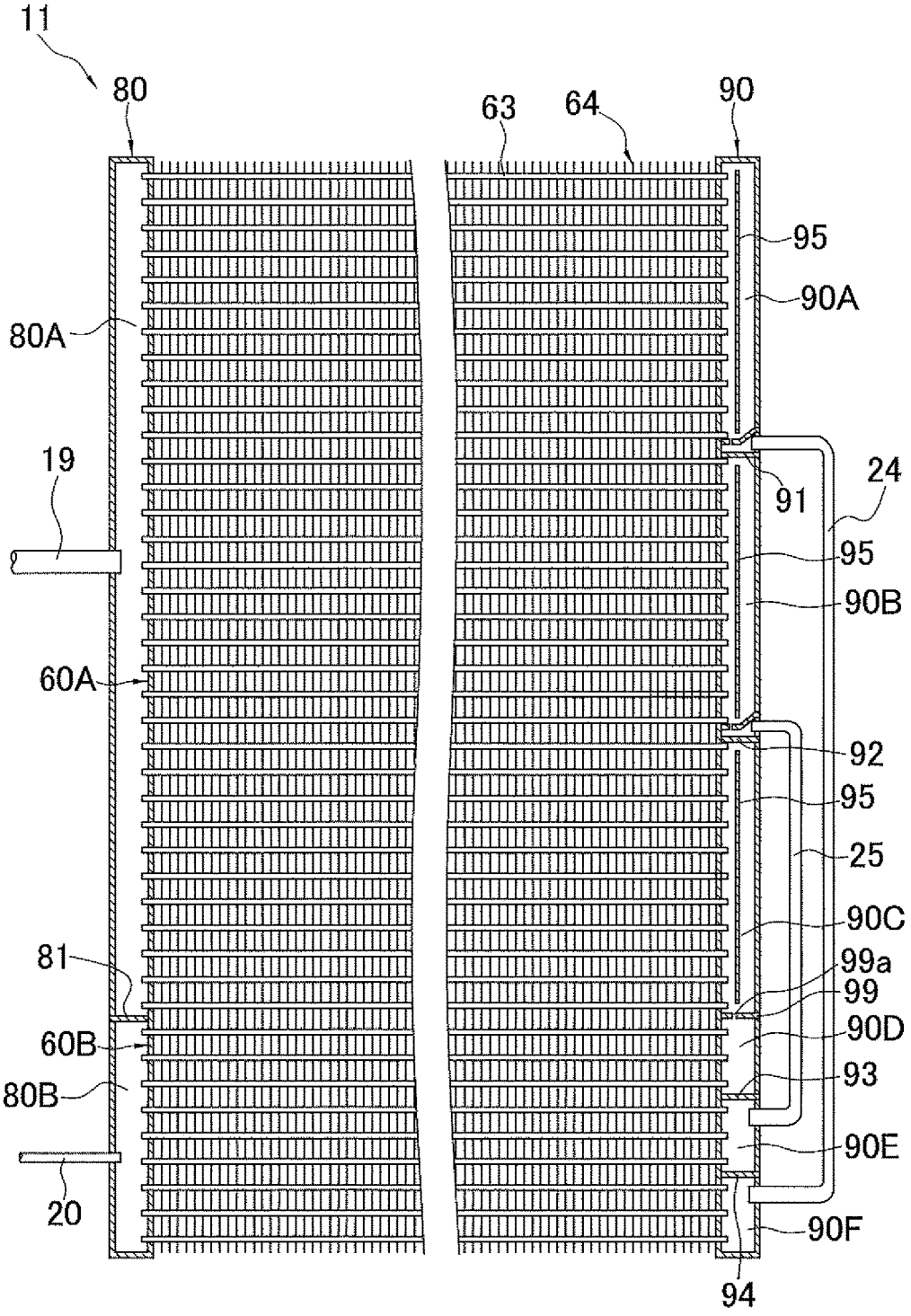
FIG. 7 is a structure diagram explaining flow of refrigerant in the outdoor heat exchanger.

FIG. 2 is an external perspective view of the outdoor unit 2. FIG. 3 is a front elevation of the outdoor unit 2 (illustrated excluding refrigerant circuit components other than the outdoor heat exchanger 11). FIG. 4 is a schematic perspective view of the outdoor heat exchanger 11. FIG. 5 is a partial enlarged view of a heat exchanging unit 60 illustrated in FIG. 4. FIG. 6 is a schematic drawing illustrating a state of attachment of fins 64 to flat multi-hole tubes 63. FIG. 7 is a structure diagram explaining flow of refrigerant in the outdoor heat exchanger 11.

(3-1) Overall Structure

The outdoor unit 2 is a top-blown-type heat exchanging unit that sucks the air through side faces of a casing 40 and blows out the air from the top face of the casing 40. The outdoor unit 2 mainly has the casing 40 in the form of nearly rectangular box; the outdoor fan 15 as an air blower; and refrigerant circuit components that compose a part of the refrigerant circuit 6 including equipment 7, 8, 11 such as the compressor and the outdoor heat exchanger, the valves 10, 12 to 14 such as the four-way switching valve and the outdoor expansion valve, and the refrigerant pipes 16 to 22. Note that terms "upper", "lower", "left", "right", "front", "rear", "front face", and "rear face" in the description below will follow the directionality when the outdoor unit 2 illustrated in FIG. 2 is viewed from the front (diagonally front left in the drawing), unless specifically noted otherwise.

The casing 40 mainly has a bottom frame 42 that is laid across a pair of installation legs 41 that are laterally extended, supports 43 that extend vertically from corners of the bottom frame 42, a fan module 44 mounted on the top ends of the supports 43, and a front panel 45, and has air intake ports 40*a*, 40*b*, 40*c* formed in side faces (rear face, and left and right side faces, herein), and an air blow-out port 40*d* formed in the top face.

The bottom frame 42 forms a bottom face of the casing 40. On the bottom frame 42, disposed is the outdoor heat exchanger 11. Now the outdoor heat exchanger 11 is nearly U-shaped in plan view, and is faced to the rear face, and the left and right side faces of the casing 40, so as to substantially compose the rear face, and the left and right side faces of the casing 40.

Above the outdoor heat exchanger 11, disposed is the fan module 44 that composes a portion of the casing 40 above the front, rear, left, and right supports 43, and the top face of the casing 40. The fan module 44 is an assemblage having a nearly rectangular box with an opened top and an opened bottom, and the outdoor fan 15 housed therein. The opened top of the fan module 44 serves as a blow-out port 40*d*, and a blow-out grill 46 is provided to the blow-out port 40*d*. The outdoor fan 15 is disposed in the casing 40 while facing the blow-out port 40*d*, and serves as an air blower that incorporates air through the intake ports 40*a*, 40*b*, 40*c* into the casing 40, and outputs the air through the blow-out port 40*d*.

The front panel 45 is laid across the supports 43 on the front side, and composes the front face of the casing 40.

The casing 40 also houses refrigerant circuit components, other than the outdoor fan 15 and the outdoor heat exchanger 11 (FIG. 2 illustrates the accumulator 7, the compressor 8 and the refrigerant pipes 16 to 18). The compressor 8 and the accumulator 7 are disposed on the bottom frame 42.

As described above, the outdoor unit 2 has the casing 40 with the air intake ports 40*a*, 40*b*, 40*c* formed in the side faces (the rear face and the left and right side faces, herein), and with the air blow-out port 40*d* formed in the top face; the outdoor fan 15 disposed in the casing 40 while facing the blow-out port 40*d*; and the outdoor heat exchanger 11 disposed in the casing 40 and below the outdoor fan 15. In such top-blown-type unit structure having the outdoor heat exchanger 11 disposed below the outdoor fan 15, the flow velocity of the air that flows through the outdoor heat exchanger 11 tends to be larger in the upper part of the outdoor heat exchanger 11 than in the lower part of the outdoor heat exchanger 11 (see FIG. 3).

(3-2) Outdoor Heat Exchanger

The outdoor heat exchanger 11 performs heat exchange between the refrigerant and the outdoor air, and mainly has a first header collecting pipe 80, a second header collecting pipe 90, a plurality of flat multi-hole tubes 63, and a plurality of fins 64. In this example, all of the first header collecting pipe 80, the second header collecting pipe 90, the flat multi-hole tubes 63 and the fins 64 are made of aluminum or an aluminum alloy, and joined together by brazing.

Both of the first header collecting pipe 80 and the second header collecting pipe 90 are members in the form of long hollow cylinder. The first header collecting pipe 80 is attached to one end (herein, on the left front side in FIG. 4) of the outdoor heat exchanger 11 so as to stand vertically, meanwhile the second header collecting pipe 90 is attached to the other end (herein, on the right front side in FIG. 4) of the outdoor heat exchanger 11 so as to stand vertically.

Each flat multi-hole tube 63 has flat faces 63*a* that serve as a heat transfer surface and are faced vertically, and a large number of fine channels 63*b* through which the refrigerant flows. A plurality of the flat multi-hole tubes 63 are arranged while being vertically juxtaposed, and have both ends connected to the first header collecting pipe 80 and the second header collecting pipe 90. Note that the plurality of flat multi-hole tubes 63 in one or more embodiments is disposed at regular intervals according to a predetermined pitch in the vertical direction. Each fin 64 partitions a space between every adjacent flat multi-hole tubes 63 into a plurality of air flow paths through which the air flows, and has formed therein a plurality of slit-like notches 64*a* that extend horizontally, into which the plurality of flat multi-hole tubes 63 can be inserted. Each notch 64*a* of the fin 64 is shaped substantially identical to the outer profile of a cross-section of each flat multi-hole tube 63.

The outdoor heat exchanger 11 has the heat exchanging unit 60 that is composed of the flat multi-hole tubes 63 arranged multiply in the vertical direction, and the fins 64 fitted thereto. The heat exchanging unit 60 has an upper stage heat exchanging unit 60A on the upper stage side, and a lower stage heat exchanging unit 60B on the lower stage side.

The first header collecting pipe 80 has the inner space partitioned in the vertical direction, by a partition plate 81 that horizontally extends, into a gas-side inlet and outlet communication space 80A and a liquid-side inlet and outlet communication space 80B, which correspond to the upper stage heat exchanging unit 60A and the lower stage heat exchanging unit 60B, respectively. The gas-side inlet and outlet communication space 80A communicates with the flat multi-hole tubes 63 that compose the corresponding upper stage heat exchanging unit 60A. Meanwhile, the liquid-side inlet and outlet communication space 80B communicates with the flat multi-hole tubes 63 that compose the corresponding lower stage heat exchanging unit 60B.

To the gas-side inlet and outlet communication space 80A of the first header collecting pipe 80, also connected is a refrigerant pipe 19 (see FIG. 1) through which the refrigerant fed from the compressor 8, during the cooling operation, is allowed to pass towards the gas-side inlet and outlet communication space 80A.

Meanwhile, to the liquid-side inlet and outlet communication space 80B of the first header collecting pipe 80, also connected is the refrigerant pipe 20 (see FIG. 1) through which the refrigerant having passed through the outdoor expansion valve 12, during the heating operation, is allowed to pass towards the liquid-side inlet and outlet communication space 80B.

The second header collecting pipe 90 has the inner space partitioned into a plurality of vertically juxtaposed spaces, by partition plates 91, 92, 93, 94 that individually extend horizontally and are juxtaposed vertically. The inner space in the second header collecting pipe 90, particularly a space surrounded by the partition plate 92 and the partition plate 93 in the vertical direction is further divided vertically by a diaphragm with nozzle 99. The inner space of the second header collecting pipe 90 is therefore composed of a first upper stage turnaround communication space 90A, a second upper stage turnaround communication space 90B, a third upper stage turnaround communication space 90C, a first lower stage turnaround communication space 90D, a second lower stage turnaround communication space 90E, and a third lower stage turnaround communication space 90F, which are juxtaposed in that order from the top to the bottom. The first upper stage turnaround communication space 90A, the second upper stage turnaround communication space 90B, and the third upper stage turnaround communication space 90C communicate with the flat multi-hole tubes 63 in the corresponding upper stage heat exchanging unit 60A. The first lower stage turnaround communication space 90D, the second lower stage turnaround communication space 90E, and the third lower stage turnaround communication space 90F communicate with the flat multi-hole tubes 63 in the corresponding lower stage heat exchanging unit 60B. The third upper stage turnaround communication space 90C and the first lower stage turnaround communication space 90D, although being partitioned by the diaphragm with nozzle 99, vertically communicate with each other through a nozzle 99*a* provided so as to extend vertically through the diaphragm with nozzle 99. Meanwhile, the first upper stage turnaround communication space 90A and the third lower stage turnaround communication space 90F are connected by the first connection pipe 24 that is a separate pipe from the second header collecting pipe 90. The second upper stage turnaround communication space 90B and the second lower stage turnaround communication space 90E are connected by the second connection pipe 25 that is a separate pipe from the second header collecting pipe 90. Both of the first connection pipe 24 and the second connection pipe 25 are cylindrical pipes, with a simple structure and high compressive strength. The first connection pipe 24 and the second connection pipe 25 are connected to the second header collecting pipe 90 at portions on the second header collecting pipe 90, which reside on the side opposite to the side where the flat multi-hole tubes 63 are connected, while aligning the axial directions horizontally.

When the thus composed outdoor heat exchanger 11 functions as an evaporator of refrigerant, the refrigerant, coming through the refrigerant pipe 20 and entering the liquid-side inlet and outlet communication space 80B of the first header collecting pipe 80, then flows through the flat multi-hole tubes 63 in the lower stage heat exchanging unit 60B connected to the liquid-side inlet and outlet communication space 80B, into the first lower stage turnaround communication space 90D, the second lower stage turnaround communication space 90E, and the third lower stage turnaround communication space 90F of the second header collecting pipe 90. The refrigerant that has entered the first lower stage turnaround communication space 90D then flows through the nozzle 99*a* of the diaphragm with nozzle 99 into the third upper stage turnaround communication space 90C, and flows through the flat multi-hole tubes 63 in the upper stage heat exchanging unit 60A connected to the third upper stage turnaround communication space 90C, into the gas-side inlet and outlet communication space 80A of the first header collecting pipe 80. The refrigerant that has entered the second lower stage turnaround communication space 90E then flows through the second connection pipe 25 into the second upper stage turnaround communication space 90B, and flows through the flat multi-hole tubes 63 in the upper stage heat exchanging unit 60A connected to the second upper stage turnaround communication space 90B, into the gas-side inlet and outlet communication space 80A of the first header collecting pipe 80. The refrigerant that has entered the third lower stage turnaround communication space 90F then flows through the first connection pipe 24 into the first upper stage turnaround communication space 90A, and flows through the flat multi-hole tubes 63 in the upper stage heat exchanging unit 60A connected to the first upper stage turnaround communication space 90A, into the gas-side inlet and outlet communication space 80A of the first header collecting pipe 80. The refrigerant joined in the gas-side inlet and outlet communication space 80A of the first header collecting pipe 80 is then allowed to flow through the refrigerant pipe 19 to the outside of the outdoor heat exchanger 11. For the outdoor heat exchanger 11 used as a radiator of refrigerant, the aforementioned flow of refrigerant will be inverted.

(4) INTERNAL STRUCTURE OF FIRST UPPER STAGE TURNAROUND COMMUNICATION SPACE 90A, ETC

Figure 8:
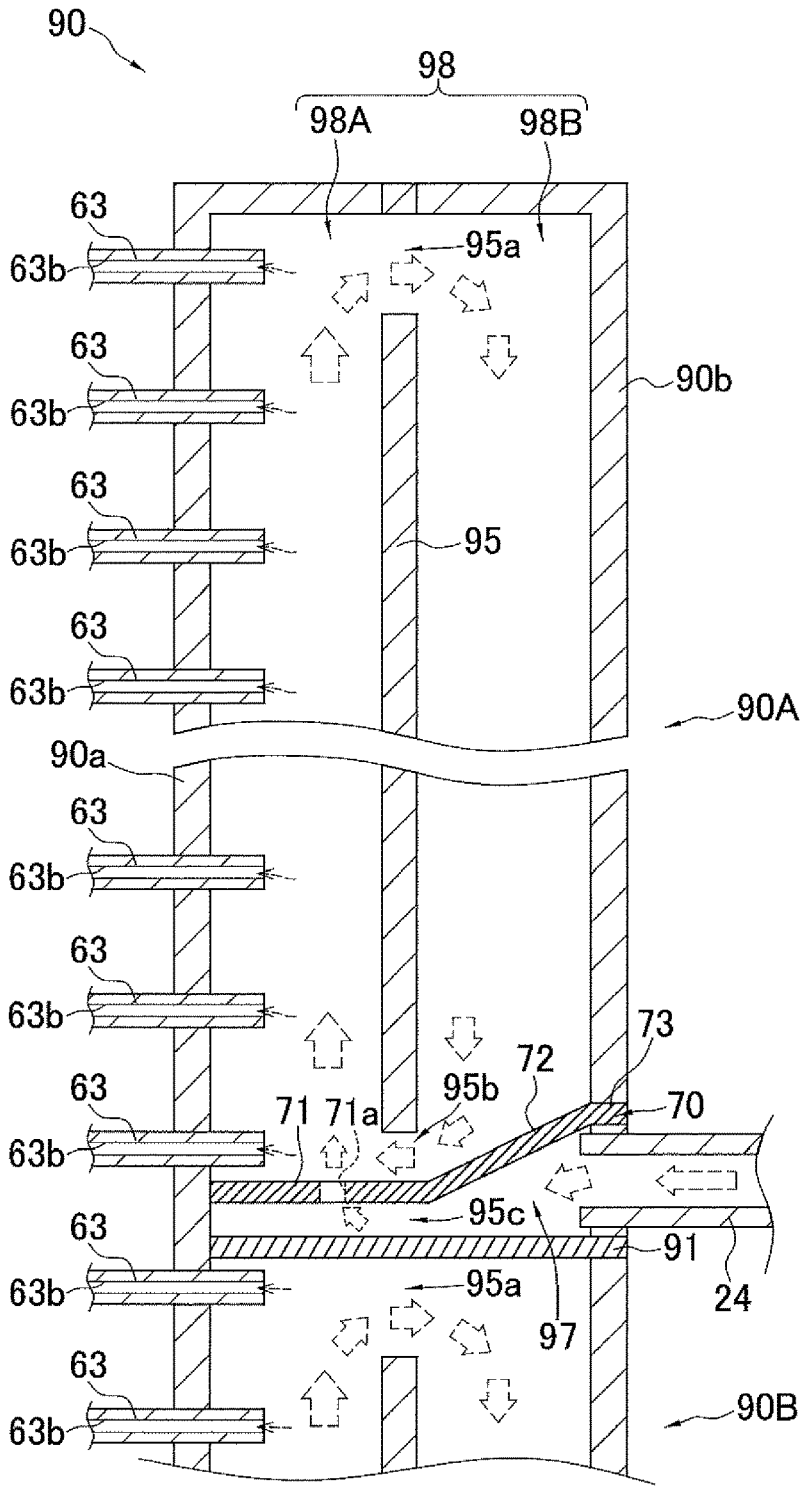
FIG. 8 is a schematic cross-sectional structure diagram, taken along an air flow direction, illustrating an upper end portion of a second header collecting pipe in the outdoor heat exchanger.
Figure 9:
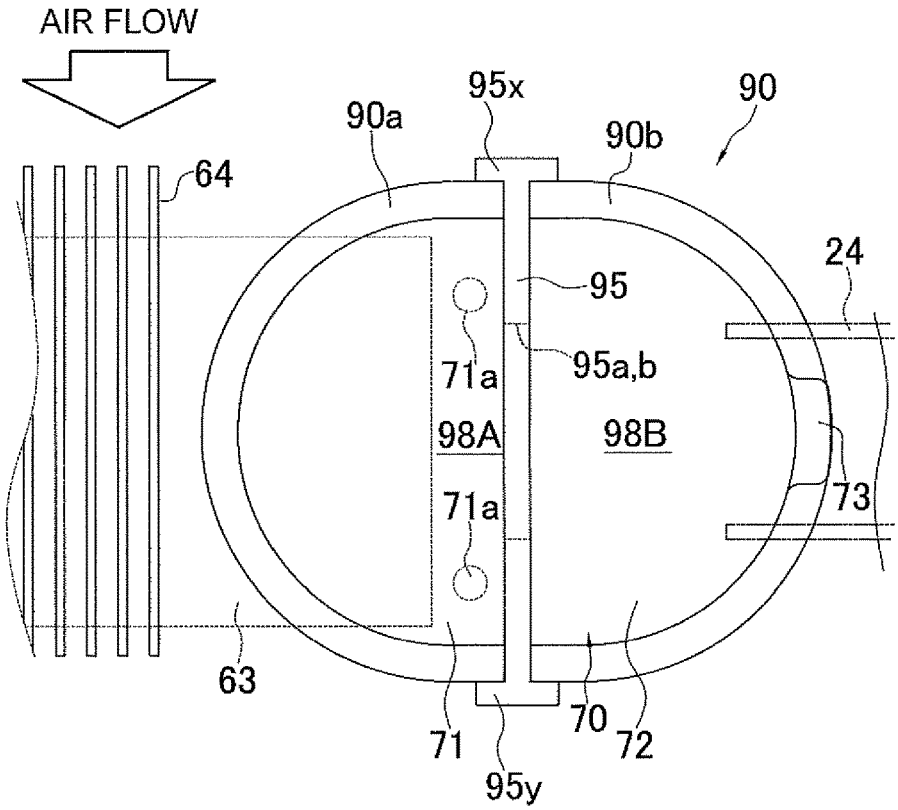
FIG. 9 is a schematic cross-sectional structure diagram, in a top view, illustrating the upper end portion of the second header collecting pipe in the outdoor heat exchanger.
Figure 10:
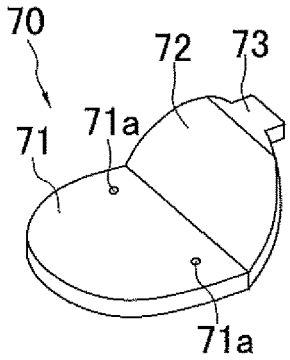
FIG. 10 is a schematic external perspective view of a partially inclined partitioning member with nozzle.
Figure 11:
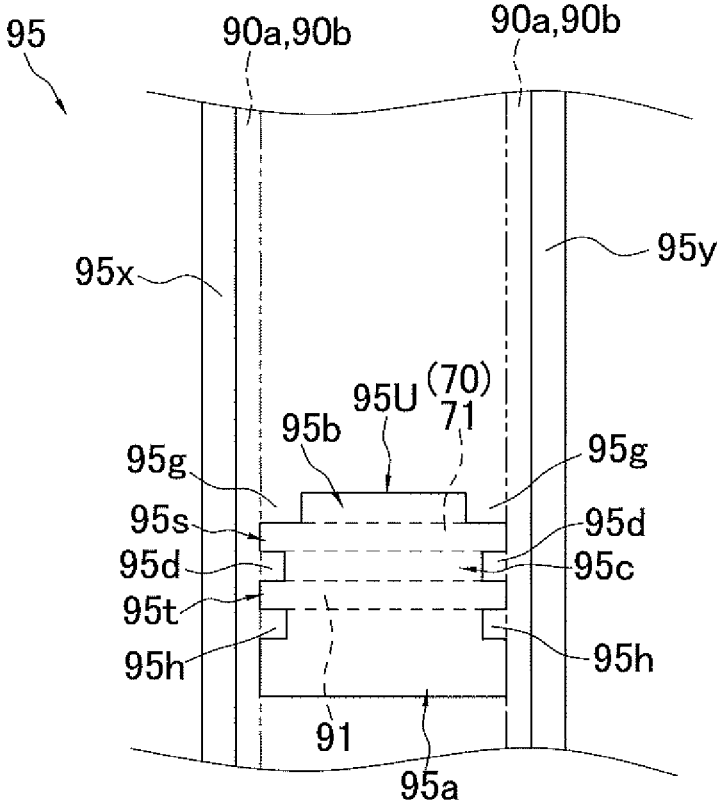
FIG. 11 is a schematic external view, from an insertion direction of the flat multi-hole tube, of a circulation diaphragm.

FIG. 8 is a schematic cross-sectional structure diagram, taken along an air flow direction, illustrating the first upper stage turnaround communication space 90A of the second header collecting pipe 90 in the outdoor heat exchanger 11. FIG. 9 is a schematic cross-sectional structure diagram, in a top view, illustrating the first upper stage turnaround communication space 90A of the second header collecting pipe 90 in the outdoor heat exchanger 11. FIG. 10 is a schematic external perspective view of a partially inclined partitioning member with nozzle 70. FIG. 11 is a schematic external view, from an insertion direction of the flat multi-hole tube 63, of a circulation diaphragm 95.

To the first upper stage turnaround communication space 90A, provided are the partially inclined partitioning member with nozzle 70 provided with the nozzle 71*a*, and a part of the circulation diaphragm 95 that extends in the vertical direction and in the air flow direction. The bottom of the first upper stage turnaround communication space 90A is covered with the partition plate 91. The partition plate 91 is a plate-shaped member having a uniform thickness, a nearly circular shape that extends in the horizontal direction, no inclined portion, and a simple structure, like the other partition plates 92, 93, and 94.

As illustrated in FIG. 11, a portion of the circulation diaphragm 95, which is laid across the first upper stage turnaround communication space 90A and the second upper stage turnaround communication space 90B, has formed therein a common opening 95U, which is an integrated opening composed of a lower communication slot 95*b*, an upper insertion opening portion 95*s*, a connection slot 95*c*, a lower insertion opening portion 95*t*, and an upper communication slot 95*a* which are adjoined in that order from the top to the bottom. The circulation diaphragm 95 has formed therein inwardly protruded upper support projections 95*d*, so as to position the forward and rear ends, in the air flow direction, of the connection slot 95*c* more inward than the forward and rear ends, in the air flow direction, of the lower insertion opening portion 95*t*. The circulation diaphragm 95 also has, below the lower insertion opening portion 95*t*, inwardly protruded lower support projections 95*h* so as to be positioned more inward from the front and rear ends, in the air flow direction, of the lower insertion opening portion 95*t*.

In this structure, the partition plate 91 is supported while being inserted into the lower insertion opening portion 95*t* that composes a part of the common opening 95U of the circulation diaphragm 95, with the top face of the partition plate 91 supported by the lower ends of the upper support projections 95*d*, and with the lower face of the partition plate 91 supported by the upper ends of the lower support projection 95*h*. Now the upper communication slot 95*a* for the second upper stage turnaround communication space 90B, and the connection slot 95*c* for the first upper stage turnaround communication space 90A are joined while placing in between the lower insertion opening portion 95*t* used for insertion and fixation of the partition plate 91. The lower insertion opening portion 95*t* used for insertion and fixation of the partition plate 91 extends to reach a first header structural member 90*a* and a second header structural member 90*b* of the second header collecting pipe 90, from the upstream side to the downstream side in the air flow direction. Meanwhile, both of the connection slot 95*c* for the first upper stage turnaround communication space 90A and the lower communication slot 95*b* for the first upper stage turnaround communication space 90A extend to right in front of the first header structural member 90*a* and the second header structural member 90*b* of the second header collecting pipe 90, rather than to reach them. The upper communication slot 95*a* that composes a part of the common opening 95U of the circulation diaphragm 95 extends not only between the front and rear parts of the lower support projections 95*h* in the air flow direction, but also downwards from these parts. The upper communication slot 95*a* has, below the lower support projections 95*h*, a part that extends further frontward and rearward, from the front and rear ends of each lower support projection 95*h* in the air flow direction. A lower part of the upper communication slot 95*a* has a width larger than the distance, in the air flow direction, between the furthest points of later-described two nozzles 71*a* provided to a nozzle forming part 71 of the partially inclined partitioning member with nozzle 70. More specifically, the lower part of the upper communication slot 95*a* for the second upper stage turnaround communication space 90B extends so as to reach the first header structural member 90*a* and the second header structural member 90*b* of the second header collecting pipe 90. It is therefore understood that the upper end of the upper communication slot 95*a* for the second upper stage turnaround communication space 90B is composed of the lower face of the partition plate 91.

The second header collecting pipe 90 is composed, as illustrated in FIG. 9, so that a first header structural member 90*a* having in a top view a near arcuate shape convex towards the flat multi-hole tubes 63 and extending in the vertical direction, and a second header structural member 90*b* having in a top view a near arcuate shape convex towards the opposite side of the flat multi-hole tubes 63 and extending in the vertical direction, clamp the circulation diaphragm 95 that extends in the vertical direction in between, in the direction the flat multi-hole tubes 63 are inserted (thickness direction of the circulation diaphragm 95). Now the circulation diaphragm 95 has, on the upwind end, an upwind end part 95*x* that is widened in the thickness direction, and has, on the downwind end, a downwind end part 95*y* that is widened in the thickness direction, wherein these end parts clamp the first header structural member 90*a* and the second header structural member 90*b* in between from the front and rear in the direction of air flow, and are fixed by blazing.

The partially inclined partitioning member with nozzle 70 partitions the first upper stage turnaround communication space 90A vertically, into a circulation space 98 that is positioned on the upper side, and an introduction space 97 that is positioned on the lower side. The partially inclined partitioning member with nozzle 70 is, as illustrated in FIG. 9, an integrated member composed of a nozzle forming part 71, an inclined part 72, and a fixable end part 73. By constructing the partially inclined partitioning member with nozzle 70 as an integrated member, the number of components can be reduced. The introduction space 97 is surrounded from the top and the bottom by the partially inclined partitioning member with nozzle 70 and the partition plate 91 both provided in the first upper stage turnaround communication space 90A. The introduction space 97 has the end of the first connection pipe 24 connected to the side opposite to the flat multi-hole tubes 63. In one or more embodiments, the flat multi-hole tube 63 is not connected to the introduction space 97.

The nozzle forming part 71 has a plate-shaped flat part that extends horizontally, and has nozzles 71*a* that extend through the thickness direction (vertical direction) on the upstream side and on the downstream side. A part of the nozzle forming part 71 has a semi-arcuate profile in a top view, placed in contact with, and brazed to, a near semi-arcuate inner circumferential face of the first header structural member 90*a*. A part of the nozzle forming part 71 opposite to the flat multi-hole tubes 63 is inserted into and fixed at the upper insertion opening portion 95*s* that composes a part of the common opening 95U of the circulation diaphragm 95. More specifically, the circulation diaphragm 95 has formed therein inwardly protruded top end support parts 95*g*, so as to position the forward and rear ends, in the air flow direction, of the lower communication slot 95*b* more inward than the forward and rear ends, in the air flow direction, of the upper insertion opening portion 95*s*. Hence, a part of the nozzle forming part 71 opposite to the flat multi-hole tubes 63 is supported while being inserted into the upper insertion opening portion 95*s* that composes a part of the common opening 95U of the circulation diaphragm 95, with the top face of the nozzle forming part 71 supported by the lower ends of the top end support parts 95*g*, and with the lower face of the nozzle forming part 71 supported by the top ends of the upper support projections 95*d*. Now the connection slot 95*c* for the first upper stage turnaround communication space 90A, and the lower communication slot 95*b* for the first upper stage turnaround communication space 90A are joined while placing in between the upper insertion opening portion 95*s* used for insertion and fixation of the nozzle forming part 71 of the partially inclined partitioning member with nozzle 70. The upper insertion opening portion 95*s* used for insertion and fixation of the nozzle forming part 71 of the partially inclined partitioning member with nozzle 70 extends to reach the first header structural member 90*a* and the second header structural member 90*b* of the second header collecting pipe 90, from the upstream side to the downstream side in the air flow direction. Hence, the lower end part of the lower communication slot 95*b* for the first upper stage turnaround communication space 90A is composed of the top face of the nozzle forming part 71 of the partially inclined partitioning member with nozzle 70 (the top face of a part, on the side opposite to the flat multi-hole tubes 63 relative to the nozzles 71*a*). The nozzle forming part 71 is positioned so as to mainly overlap an upflow space 98A in a plan view. It is understood that the connection slot 95*c* for the first upper stage turnaround communication space 90A is formed by the lower face of the nozzle forming part 71 of the partially inclined partitioning member with nozzle 70 (the lower face of a part on the side opposite to the flat multi-hole tubes 63, relative to the nozzles 71*a*), the top face of the partition plate 91, and the individual upper support projections 95*d*.

The entire part of the nozzle 71*a* formed on the upwind side in the nozzle forming part 71 is positioned further on the upwind side of the upwind-side end of the lower communication slot 95*b* formed in the circulation diaphragm 95. Similarly, the entire part of the nozzle 71*a* formed on the downwind side in the nozzle forming part 71 is positioned further on the downwind side of the downwind-side end of the lower communication slot 95*b* formed in the circulation diaphragm 95. That is, a virtual space, defined by extending the lower communication slot 95*b* formed in the circulation diaphragm 95 towards the side the flat multi-hole tubes 63 are connected, overlaps in a top view neither of the nozzles 71*a* formed on the upwind side and on the downwind side in the nozzle forming part 71.

Moreover, each nozzle 71*a* formed in the nozzle forming part 71 is positioned so as to keep a closest distance of 1 mm or longer away from the circulation diaphragm 95, and so as to keep a closest distance of 1 mm or longer also away from the inner circumferential face of the first header structural member 90*a* of the second header collecting pipe 90.

The inclined part 72 is a plate-shaped part that extends so as to be continued from a part, on the side opposite to the flat multi-hole tubes 63, of the nozzle forming part 71 of the partially inclined partitioning member with nozzle 70, and has an inclined face that inclines so as to be positioned more upwardly, towards the side opposite to the flat multi-hole tubes 63. Also the inclined part 72 has a part with a semi-arcuate profile, placed in contact with, and brazed to, a near semi-arcuate inner circumferential face of the second header structural member 90*b*. The inclined part 72 is positioned so as to mainly overlap a downflow space 98B in a plan view.

The fixable end part 73 extends continuously from a part, on the side opposite to the flat multi-hole tubes 63, of the inclined part 72, and has a plate-shaped flat part that extends in the horizontal direction. The fixable end part 73 is positioned in an opening provided in the second header structural member 90*b*, and is brazed while being surrounded by the opening from the top, bottom, front, and rear sides.

Also above the partition plate 92 that composes the bottom of the second upper stage turnaround communication space 90B, provided is the partially inclined partitioning member with nozzle 70 having a structure same as described above.

For the manufacturing, the partially inclined partitioning member with nozzle 70 is preliminarily inserted, together with the partition plates 91, 92, into the openings for insertion provided to the circulation diaphragm 95, and then sandwiched by the first header structural member 90*a* and the second header structural member 90*b*.

The circulation diaphragm 95 includes a part that extends in the vertical direction and in the air flow direction in the first upper stage turnaround communication space 90A, particularly in a space above the partially inclined partitioning member with nozzle 70. The circulation diaphragm 95 partitions inside the circulation space 98, into the upflow space 98A that has the flat multi-hole tubes 63 connected thereto and operates to bring up the refrigerant when used in an evaporator mode, and the downflow space 98B that operates to bring down the refrigerant when used in an evaporator mode. The circulation diaphragm 95 also partitions the second upper stage turnaround communication space 90B and the third upper stage turnaround communication space 90C in the same way, into the upflow space 98A and the downflow space 98B. That is, the circulation diaphragm 95 is composed of a vertically joined integrated plate-shaped member in the first upper stage turnaround communication space 90A, the second upper stage turnaround communication space 90B, and the third upper stage turnaround communication space 90C.

The nozzle 71*a* provided to the nozzle forming part 71 of the partially inclined partitioning member with nozzle 70 is positioned so as to communicate with the upflow space 98A, that is, at a position that overlaps the upflow space 98A in a plan view.

The circulation diaphragm 95, disposed in the circulation space 98 of the first upper stage turnaround communication space 90A, has an upper communication slot 95*a* that extends through in the thickness direction in an upper zone of the circulation space 98, and has a lower communication slot 95*b* that extends through in the thickness direction in a lower zone of the circulation space 98. In the introduction space 97 below the partially inclined partitioning member with nozzle 70 in the first upper stage turnaround communication space 90A, the circulation diaphragm 95 has a connection slot 95*c* provided so as to extend through in the thickness direction. Note that the lower face of the partially inclined partitioning member with nozzle 70 composes a part of an upper part of the outline of the connection slot 95*c*. Now all of the end parts of the flat multi-hole tubes 63 connected to the second header collecting pipe 90 are positioned within the upflow space 98A, without reaching the circulation diaphragm 95.

The upper communication slot 95*a*, the lower communication slot 95*b*, and the connection slot 95*c* are also provided in the same way to the second upper stage turnaround communication space 90B, meanwhile the upper communication slot 95*a* and the lower communication slot 95*b* are provided to the third upper stage turnaround communication space 90C.

Owing to the structure, the introduction space 97, which is surrounded from the top and the bottom by the partially inclined partitioning member with nozzle 70 and the partition plate 91 disposed in the first upper stage turnaround communication space 90A, is formed so as to be narrowed in the vertical direction, when viewed towards the side the flat multi-hole tubes 63 are connected, since the partition plate 91 extends horizontally, whereas the partially inclined partitioning member with nozzle 70 has provided thereto the inclined part 72. Provision of the inclined part 72 to the partially inclined partitioning member with nozzle 70 can make the introduction space 97 gradually narrowed in the vertical direction, from the first connection pipe 24 towards a part below the nozzles 71*a*, rather than sharply narrowed. Hence, the refrigerant can be avoided from being affected by sudden pressure loss, when the refrigerant that comes through the first connection pipe 24 into the introduction space 97 moves in the introduction space 97 towards the part below the nozzles 71*a*.

In one or more embodiments, the outer diameter of the first connection pipe 24 is larger than the vertical interval of the plurality of flat multi-hole tubes 63, and is larger than the vertical distance in the introduction space 97, measured between the nozzle forming part 71 of the partially inclined partitioning member with nozzle 70 and the partition plate 91. The lower end of a flat multi-hole tube 63 closest to the nozzles 71*a* (nearest from the nozzles 71*a*), out of the plurality of flat multi-hole tubes 63, is positioned below the top end of the end part, on the side of connection to the first upper stage turnaround communication space 90A, of the first connection pipe 24. Such dimensional and positional relations of the first connection pipe 24 are also applicable to the second connection pipe 25 connected to the introduction space 97 of the second upper stage turnaround communication space 90B.

Both of the nozzle forming part 71 of the partially inclined partitioning member with nozzle 70, and the partition plate 91, which are disposed in the first upper stage turnaround communication space 90A, are placed between the vertically juxtaposed flat multi-hole tubes 63.

(5) FLOW OF REFRIGERANT IN FIRST UPPER STAGE TURNAROUND COMMUNICATION SPACE 90A

Flow of refrigerant in the first upper stage turnaround communication space 90A, when the outdoor heat exchanger 11 in the aforementioned structure is used as an evaporator of refrigerant, will be explained below.

The refrigerant that comes through the first connection pipe 24 into the introduction space 97 below the partially inclined partitioning member with nozzle 70 partially moves below the upflow space 98A, and is then blown up through the nozzles 71*a* in the nozzle forming part 71 of the partially inclined partitioning member with nozzle 70, into the upflow space 98A. Since there is no flat multi-hole tube 63 connected to the introduction space 97, the refrigerant does not flow from the introduction space 97 directly into the flat multi-hole tube 63.

The refrigerant fed into the upflow space 98A ascends in the upflow space 98A, during which the refrigerant is distributed into the flat multi-hole tubes 63 connected at every level of height. The refrigerant, upon reaching the top end or around of the upflow space 98A, is then fed through the upper communication slot 95*a* of the circulation diaphragm 95 into the downflow space 98B, and descends in the downflow space 98B.

The refrigerant coming down in the downflow space 98B then descends at around the bottom end of the downflow space 98B, along the top face of the inclined part 72 of the partially inclined partitioning member with nozzle 70 towards the flat multi-hole tubes 63. The refrigerant thus descended in the downflow space 98B is guided through the lower communication slot 95*b* of the circulation diaphragm 95 again into the upflow space 98A. The refrigerant can circulate in the circulation space 98 in this way.

The structure and flow of refrigerant in the second upper stage turnaround communication space 90B are same as the structure and flow of refrigerant in the first upper stage turnaround communication space 90A, and will not be explained again.

Although the structure and flow of refrigerant in the third upper stage turnaround communication space 90C are different from the first upper stage turnaround communication space 90A, in that the partially inclined partitioning member with nozzle 70 in the first upper stage turnaround communication space 90A corresponds to the diaphragm with nozzle 99 that composes the lower end of the third upper stage turnaround communication space 90C, the other structure and flow of refrigerant remain identical, so that the explanation will be skipped.

(6) FEATURES 6-1

The outdoor heat exchanger 11 according to one or more embodiments is constructed so that the connection slot 95*c* which is an opening formed in the circulation diaphragm 95 of the second header collecting pipe 90, and the upper insertion opening portion 95*s* into which a part of the partially inclined partitioning member with nozzle 70 is inserted, are contained in the common opening 95U as an integrated opening, rather than being given as independent openings.

Figure 24:
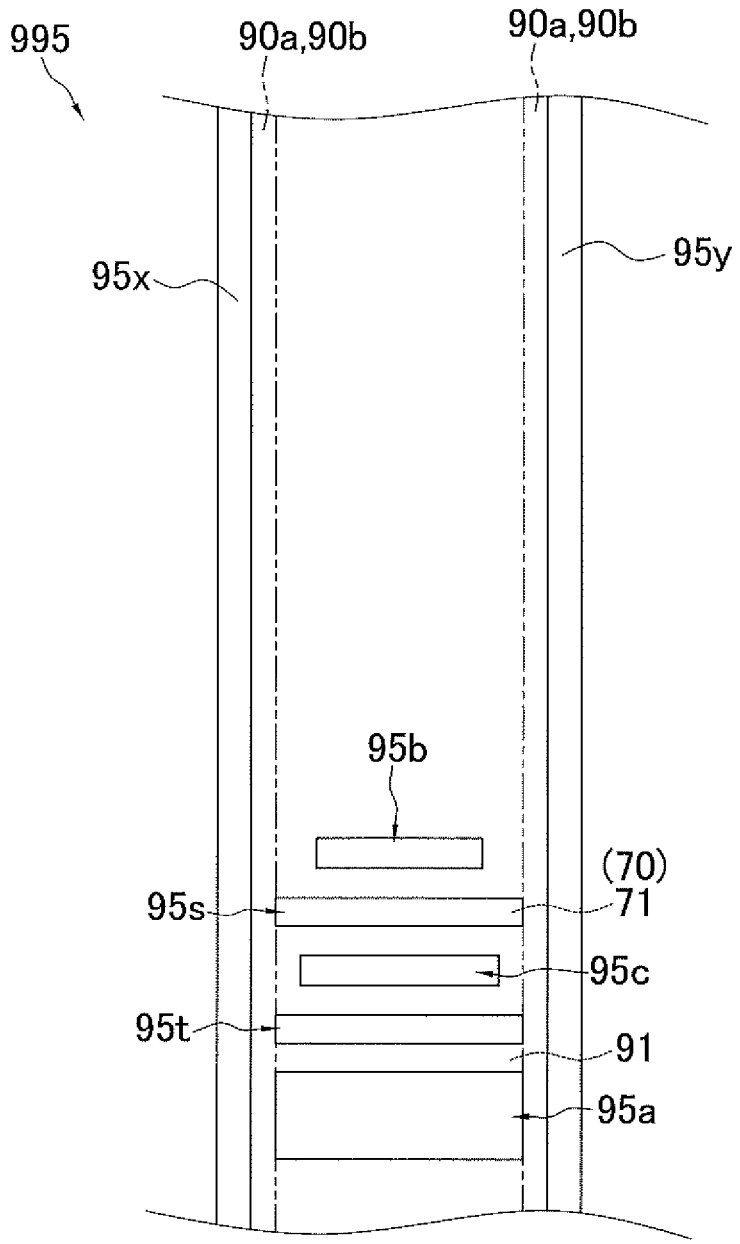
FIG. 24 is a schematic external view, from an insertion direction of the flat multi-hole tube, of a circulation diaphragm according to Comparative Example.

Hence, as compared with a case where the connection slot 95*c*, and the upper insertion opening portion 95*s* into which a part of the partially inclined partitioning member with nozzle 70 is inserted, are given as independent openings (in a typical case such as a circulation diaphragm 995 according to Comparative Example illustrated in FIG. 24, in which the connection slot 95*c* and the upper insertion opening portion 95*s* are given as independent openings juxtaposed in the longitudinal direction of the second header collecting pipe 90), the distance from the lower end of the connection slot 95*c* to the top end of the upper insertion opening portion 95*s*, into which the part of the partially inclined partitioning member with nozzle 70 is inserted, may be shortened, making it possible to more densely disposing the flat multi-hole tubes 63 in the longitudinal direction of the second header collecting pipe 90. In addition, the second header collecting pipe 90 may be shortened in the longitudinal direction, when compared among the outdoor heat exchangers 11 composed of the same components.

Thus enabled are improvement in air conditioning performance of the air conditioner 1 or downsizing of the air conditioner 1, through higher integration of the flat multi-hole tubes 63 in the outdoor heat exchanger 11.

6-2

The outdoor heat exchanger 11 according to one or more embodiments is constructed so that the inner circumference of the common opening 95U, formed in the circulation diaphragm 95 of the second header collecting pipe 90, has the top end support parts 95*g* and the upper support projections 95*d*. This enables positioning of the partially inclined partitioning member with nozzle 70 in the longitudinal direction of the second header collecting pipe 90, making use of the inner circumference of the common opening 95U.

The outdoor heat exchanger 11 according to one or more embodiments is also constructed so that the inner circumference of the common opening 95U, formed in the circulation diaphragm 95 of the second header collecting pipe 90, has the upper support projections 95*d* and the lower support projections 95*h*. This enables positioning of the partition plate 91 across the longitudinal direction of the second header collecting pipe 90, making use of the inner circumference of the common opening 95U.

6-3

The outdoor heat exchanger 11 according to one or more embodiments is constructed so that the connection slot 95*c* which is an opening formed in the circulation diaphragm 95 of the second header collecting pipe 90, the upper insertion opening portion 95*s* into which a part of the partially inclined partitioning member with nozzle 70 is inserted, and the lower insertion opening portion 95*t* into which the partition plate 91 is inserted, are contained in the common opening 95U as an integrated opening, rather than being given as independent openings. Hence, as compared with a case typically illustrated in FIG. 24, in which the connection slot 95*c*, the upper insertion opening portion 95*s*, and the lower insertion opening portion 95*t* are given as independent openings juxtaposed in the longitudinal direction of the second header collecting pipe 90, the above-described embodiments can more densely dispose the flat multi-hole tubes 63 in the longitudinal direction of the second header collecting pipe 90, and can highly integrate the flat multi-hole tubes 63. This makes it possible to further improve the air conditioning performance of the air conditioner 1, or to further shorten the second header collecting pipe 90 in the longitudinal direction, when compared among the outdoor heat exchangers 11 composed of the same components, and to further downsize the air conditioner 1.

6-4

In the outdoor heat exchanger 11 according to one or more embodiments, the flat multi-hole tubes 63 are not connected to the introduction space 97. This successfully avoids drift of refrigerant among the flat multi-hole tubes 63, which would be anticipated if the flat multi-hole tubes 63 are connected to the introduction space 97, and the refrigerant would rush to these flat multi-hole tubes 63.

6-5

The second header collecting pipe 90 of the outdoor heat exchanger 11 according to one or more embodiments has the inner space partitioned into the upflow space 98A to which the flat multi-hole tubes 63 are connected, and the downflow space 98B, successfully narrowing a channel through which the ascending refrigerant flows. Into a space composing such narrowed channel, there is fed the refrigerant after passing through the nozzles 71*a* formed in the nozzle forming part 71 of the partially inclined partitioning member with nozzle 70. Hence the refrigerant fed into the introduction space 97 is allowed to reach even higher in a space above the nozzle forming part 71. In particular, even if the outdoor heat exchanger 11 is operated in an operation mode with a relatively small volume of circulation of refrigerant, enough refrigerant may be allowed to reach even the flat multi-hole tubes 63 far above the nozzle forming part 71, thus making it possible to feed enough refrigerant also to the flat multi-hole tubes 63 connected to the upper part of the first upper stage turnaround communication space 90A of the second header collecting pipe 90 (the same will apply to the second upper stage turnaround communication space 90B).

6-6

In the outdoor heat exchanger 11 according to one or more embodiments, the first connection pipe 24 and the second connection pipe 25 are connected to the introduction space 97, in the second header collecting pipe 90 on the side opposite to the side the flat multi-hole tubes 63 are connected. Even in such case, since the nozzles 71*a* are formed in the nozzle forming part 71 which is a part of the partially inclined partitioning member with nozzle 70 on the side the flat multi-hole tubes 63 are connected, the refrigerant can ascend through the nozzles 71*a* and in the upflow space 98A which is a space on the side the flat multi-hole tubes 63 are connected, even in the structure where the refrigerant is fed to a part in the introduction space 97 far from the side the flat multi-hole tubes 63 are connected.

6-7

The second header collecting pipe 90 of the outdoor heat exchanger 11 according to one or more embodiments has the upflow space 98A and the downflow space 98B, which communicate at the upper parts through the upper communication slot 95*a*, and at the lower parts through the lower communication slot 95*b*. Hence the volume of circulation of refrigerant in the outdoor heat exchanger 11 will increase, making it possible to circulate the refrigerant through the upper communication slot 95*a*, the downflow space 98B and the lower communication slot 95*b* back into the upflow space 98A again, even in a situation that the refrigerant tends to concentrate in the upper part of the upflow space 98A after vigorously ascending in the upflow space 98A.

Hence even if the volume of circulation of refrigerant varies, the refrigerant may equally be distributed into the flat multi-hole tubes 63 connected at every level of height, making it possible to suppress the drift of refrigerant among the plurality of flat multi-hole tubes 63.

In addition, the outdoor heat exchanger 11 according to one or more embodiments is constructed so that the connection slot 95*c* which is an opening formed in the circulation diaphragm 95 of the second header collecting pipe 90, the upper insertion opening portion 95*s* into which a part of the partially inclined partitioning member with nozzle 70 is inserted, the lower insertion opening portion 95*t* into which the partition plate 91 is inserted, and the lower communication slot 95*b* through which the refrigerant is circulated, are contained in the common opening 95U as an integrated opening, rather than being given as independent openings. Hence, as compared with the case typically illustrated in FIG. 24, in which the connection slot 95*c*, the upper insertion opening portion 95*s*, the lower insertion opening portion 95*t*, and the lower communication slot 95*b* are given as independent openings juxtaposed in the longitudinal direction of the second header collecting pipe 90, the above-described embodiments can more densely dispose the flat multi-hole tubes 63 in the longitudinal direction of the second header collecting pipe 90, and can highly integrate the flat multi-hole tubes 63. This makes it possible to further improve the air conditioning performance of the air conditioner 1, or to further shorten the second header collecting pipe 90 in the longitudinal direction, when compared among the outdoor heat exchangers 11 composed of the same components, and to further downsize the air conditioner 1.

6-8

The outdoor heat exchanger 11 according to one or more embodiments is constructed so that the connection slot 95*c* which is an opening for the first upper stage turnaround communication space 90A and is formed in the circulation diaphragm 95 of the second header collecting pipe 90, the upper insertion opening portion 95*s* into which a part of the partially inclined partitioning member with nozzle 70 is inserted, the lower insertion opening portion 95*t* into which the partition plate 91 is inserted, and the upper communication slot 95*a* which is an opening for the second upper stage turnaround communication space 90B, are contained in the common opening 95U as an integrated opening, rather than being given as independent openings. Hence, even in a relation between the first upper stage turnaround communication space 90A and the second upper stage turnaround communication space 90B in which the refrigerant in the form of isolated streams can flow, it now becomes possible to more densely dispose the flat multi-hole tubes 63 in the longitudinal direction of the second header collecting pipe 90, to further improve the air conditioning performance of the air conditioner 1 as a result of higher integration of the flat multi-hole tubes 63, to further shorten the second header collecting pipe 90 in the longitudinal direction, when compared among the outdoor heat exchangers 11 composed of the same components, as well as to further downsize the air conditioner 1.

6-9

The outdoor heat exchanger 11 according to one or more embodiments is constructed so that the connection slot 95*c* which is an opening for the first upper stage turnaround communication space 90A and is formed in the circulation diaphragm 95 of the second header collecting pipe 90, the upper insertion opening portion 95*s* into which a part of the partially inclined partitioning member with nozzle 70 is inserted, the lower insertion opening portion 95*t* into which the partition plate 91 is inserted, the lower communication slot 95*b*, and the upper communication slot 95*a* which is an opening for the second upper stage turnaround communication space 90B, are contained in the common opening 95U as an integrated opening, rather than being given as independent openings. Hence, even in a relation between the first upper stage turnaround communication space 90A and the second upper stage turnaround communication space 90B in which the refrigerant in the form of isolated streams can flow, it now becomes possible to more densely dispose the flat multi-hole tubes 63 in the longitudinal direction of the second header collecting pipe 90, to further improve the air conditioning performance of the air conditioner 1 as a result of higher integration of the flat multi-hole tubes 63, to further shorten the second header collecting pipe 90 in the longitudinal direction, when compared among the outdoor heat exchangers 11 composed of the same components, as well as to further downsize the air conditioner 1.

6-10

The outdoor heat exchanger 11 according to one or more embodiments is constructed so that the upper communication slot 95*a* of the common opening 95U formed in the circulation diaphragm 95 of the second header collecting pipe 90 has an aperture area larger than an aperture area of the lower communication slot 95*b*. Hence, in a situation that the refrigerant ejected through the nozzles 71*a* is fed abundantly into the upper part in the upflow space 98A, such wide upper communication slot 95*a* can allow the refrigerant to pass easily, and can more likely to guide the refrigerant to the downflow space 98B. This consequently avoids the refrigerant from being excessively concentrated in the upper part of the upflow space 98A.

6-11

In the outdoor heat exchanger 11 according to one or more embodiments, a virtual space, defined by extending the lower communication slot 95*b* towards the side the flat multi-hole tubes 63 are connected, is disposed so as to overlap in a top view neither of the nozzles 71*a* formed on the upwind side and on the downwind side in the nozzle forming part 71. This successfully makes flow of the refrigerant, which is blown from the introduction space 97 through the nozzles 71*a* formed in the nozzle forming part 71 up into the upflow space 98A, less likely to be inhibited by the refrigerant that is returned from the downflow space 98B through the lower communication slot 95*b* back into the upflow space 98A.

6-12

In the outdoor heat exchanger 11 according to one or more embodiments, each nozzle 71*a* formed in the nozzle forming part 71 is positioned so as to keep a closest distance of 1 mm or longer away from the circulation diaphragm 95, and so as to keep a closest distance of 1 mm or longer also away from the inner circumferential face of the first header structural member 90*a* of the second header collecting pipe 90. Hence, the nozzles 71*a* of the nozzle forming part 71 are now successfully avoided from being buried with a brazing filler material, even if the partially inclined partitioning member with nozzle 70 is blazed onto the first header structural member 90*a* and the circulation diaphragm 95 that are covered with the brazing filler material.

In particular, the outdoor heat exchanger 11 according to one or more embodiments is designed to avoid the nozzles 71*a* of the nozzle forming part 71 from being buried with the brazing filler material, even if the ascending flow is promoted by disposing the individual nozzles 71*a* on the upwind and downwind sides formed in the nozzle forming part 71, so as not to overlap the lower communication slot 95*b* with regard to the air flow direction.

6-13

The outdoor heat exchanger 11 according to one or more embodiments is used while aligning the longitudinal direction of the second header collecting pipe 90 to the vertical direction. Such second header collecting pipe 90 enables higher integration of the flat multi-hole tubes 63 or downsizing in the vertical direction, even in a case where the refrigerant is distributed over the individual flat multi-hole tubes 63 while being blown up through the nozzles 71*a* against the gravity.

6-14

The above-described embodiments employ the structure in which the refrigerant is fed through the first connection pipe 24 into the first upper stage turnaround communication space 90A of the second header collecting pipe 90. Here, the first connection pipe 24 in which the refrigerant before being distributed is allowed to flow (or, in which the refrigerant after being joined is allowed to flow, when operated as a condenser) tends to have a large outer diameter.

Hence, in the aforementioned embodiments, the first connection pipe 24 has an outer diameter which is larger than the vertical distance in the introduction space 97, measured between the nozzle forming part 71 of the partially inclined partitioning member with nozzle 70 and the partition plate 91, and is also larger than the vertical interval of the flat multi-hole tubes 63. The top end of the first connection pipe 24 is positioned above the lower end of the flat multi-hole tube 63 right above the nozzle 71*a*.

In contrast, the outdoor heat exchanger 11 of the above-described embodiments, constructed so that the refrigerant is fed through the first connection pipe 24 into the first upper stage turnaround communication space 90A of the second header collecting pipe 90, makes it possible to narrow the vertical width of a space below the nozzles 71*a* in the introduction space 97, as compared with the space on the side where the first connection pipe 24 is connected, by employing the partially inclined partitioning member with nozzle 70 having the inclined part 72, even if the first connection pipe 24 has an outer diameter larger than the vertical interval of the flat multi-hole tubes 63; even if the first connection pipe 24 has an outer diameter larger than the vertical distance in the introduction space 97, measured between the nozzle forming part 71 of the partially inclined partitioning member with nozzle 70, and the partition plate 91; or even if the top end of the first connection pipe 24 is positioned above the lower end of the flat multi-hole tube 63 that resides right above the nozzles 71*a*.

This makes it possible to narrow the vertical width of the introduction space 97 on the side closer to the flat multi-hole tubes 63, to thereby reduce the number of flat multi-hole tubes 63 to be connected to the introduction space 97.

In particular, the above-described embodiments employ a structure in which the flat multi-hole tubes 63 are connected only to the circulation space 98 of the first upper stage turnaround communication space 90A, but not connected to the introduction space 97. Thus it becomes possible to sufficiently reduce the drift of refrigerant among the plurality of flat multi-hole tubes 63.

Even for the purpose of reducing the drift, it is no longer necessary to omit the flat multi-hole tube 63 or to add the flat multi-hole tube 63 to the circulation space 98, making it possible to avoid performance degradation, and enlargement of the outdoor heat exchanger 11.

(7) MODIFIED EXAMPLES (7-1) Modified Example A

The aforementioned embodiments have described an exemplary case where the connection slot 95*c* which is an opening formed in the circulation diaphragm 95, the upper insertion opening portion 95*s* into which a part of the partially inclined partitioning member with nozzle 70 is inserted, the lower insertion opening portion 95*t* into which the partition plate 91 is inserted, the lower communication slot 95*b* which is an opening for allowing the refrigerant to circulate in the first upper stage turnaround communication space 90A, and the upper communication slot 95*a* which is an opening for allowing the refrigerant to circulate in the second upper stage turnaround communication space 90B, are contained in the common opening 95U as an integrated opening.

Figure 12:
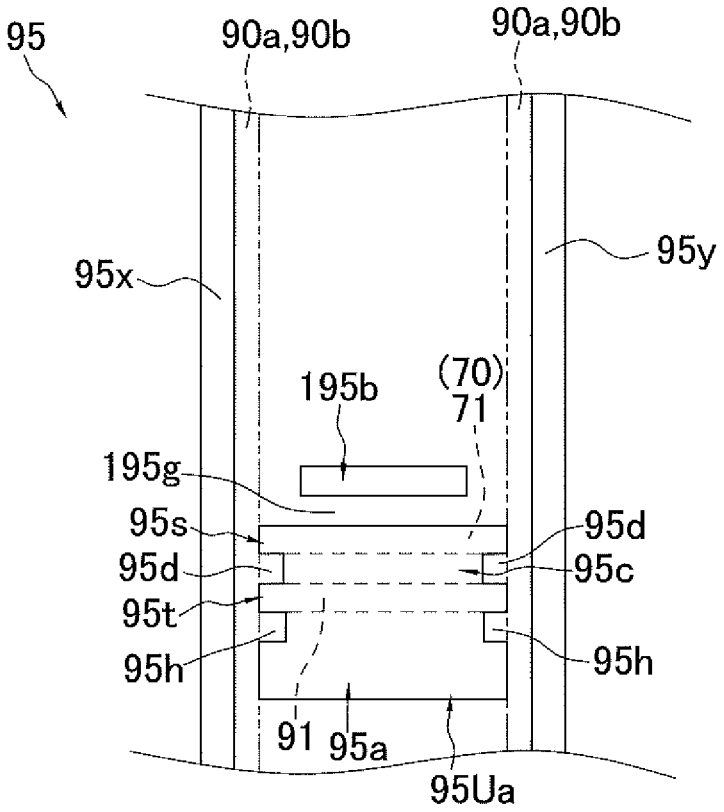
FIG. 12 is a schematic external view, from an insertion direction of the flat multi-hole tube, of a circulation diaphragm of an outdoor heat exchanger according to Modified Example A.

The common opening is, however, not limited thereto, and may be constructed for example as illustrated in FIG. 12 so that the connection slot 95*c*, the upper insertion opening portion 95*s*, the lower insertion opening portion 95*t*, and the upper communication slot 95*a* which is an opening through which the refrigerant can circulate in the second upper stage turnaround communication space 90B, are contained in a common opening 95Ua as an integrated opening, and so that a lower communication slot 195*b* which is an opening through which the refrigerant can circulate in the first upper stage turnaround communication space 90A is provided as a separate opening independent from the common opening 95Ua. In this case, a top end support part 195*g* will be formed between the lower communication slot 195*b* and the upper insertion opening portion 95*s*.

Also the common opening 95Ua, although not being integrated with the lower communication slot 195*b* unlike the common opening 95U in the aforementioned embodiments, can highly integrate the flat multi-hole tubes 63 or can downsize the outdoor heat exchanger 11, as a result of combining the upper insertion opening portion 95*s*, the connection slot 95*c*, the lower insertion opening portion 95*t*, and the upper communication slot 95*a* into an integrated opening.

(7-2) Modified Example B

Figure 13:
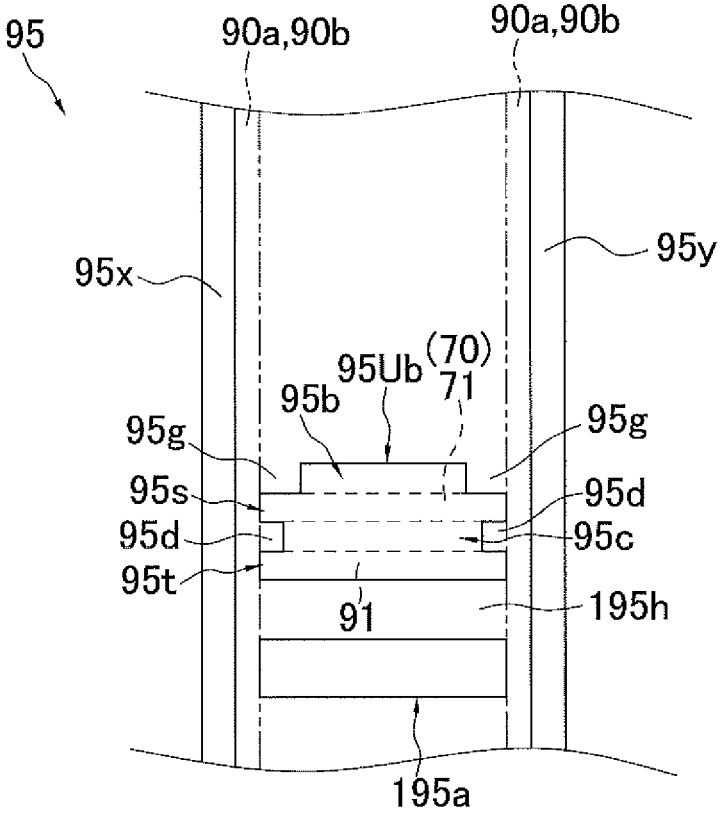
FIG. 13 is a schematic external view, from an insertion direction of the flat multi-hole tube, of a circulation diaphragm of an outdoor heat exchanger according to Modified Example B.

It may be constructed typically as illustrated in FIG. 13 so that the connection slot 95*c*, the upper insertion opening portion 95*s*, the lower insertion opening portion 95*t*, and the lower communication slot 95*b* which is an opening through which the refrigerant can circulate in the first upper stage turnaround communication space 90A, are contained in a common opening 95Ub as an integrated opening, and so that an upper communication slot 195*a* which is an opening through which the refrigerant can circulate in the second upper stage turnaround communication space 90B is provided as a separate opening independent from the common opening 95Ub. In this case, a lower support part 195*h* will be formed between the lower insertion opening portion 95*t* and the upper communication slot 195*a*.

Also the common opening 95Ub, although not being integrated with the upper communication slot 195*a* unlike the common opening 95U in the aforementioned embodiments, can highly integrate the flat multi-hole tubes 63 or can downsize the outdoor heat exchanger 11, as a result of combining the upper insertion opening portion 95*s*, the connection slot 95*c*, the lower insertion opening portion 95*t*, and the lower communication slot 95*b* into an integrated opening.

(7-3) Modified Example C

Figure 14:
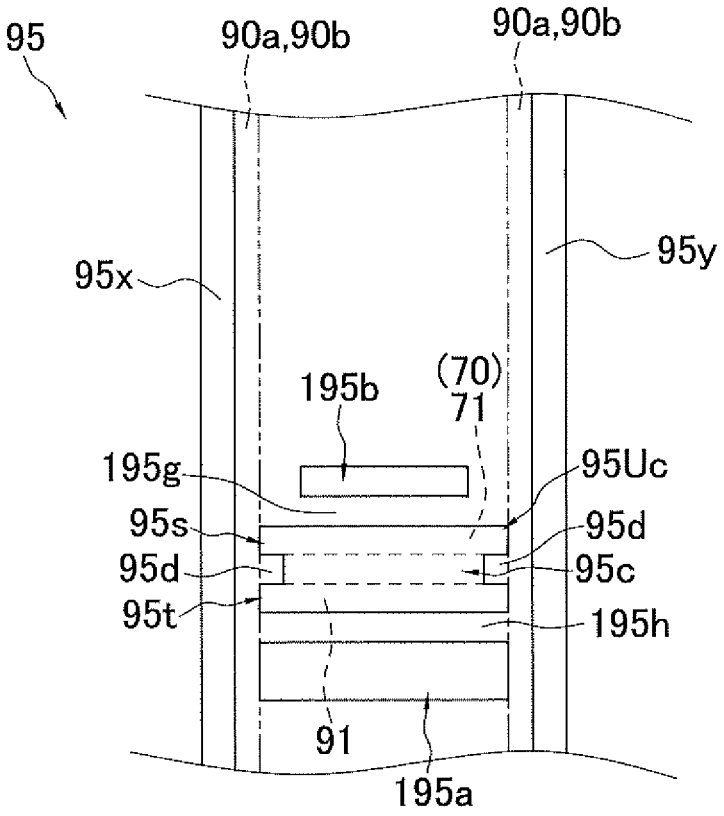
FIG. 14 is a schematic external view, from an insertion direction of the flat multi-hole tube, of a circulation diaphragm of an outdoor heat exchanger according to Modified Example C.

Alternatively as illustrated in FIG. 14, the connection slot 95*c*, the upper insertion opening portion 95*s*, and the lower insertion opening portion 95*t* may be contained in a common opening 95Uc as an integrated opening; the lower communication slot 195*b* which is an opening through which the refrigerant can circulate in the first upper stage turnaround communication space 90A may be provided as a separate opening independent from the common opening 95Uc; and also the upper communication slot 195*a* which is an opening through which the refrigerant can circulate in the second upper stage turnaround communication space 90B may be provided as a separate opening independent from the common opening 95Uc. In this case, the top end support part 195*g* will be formed between the lower communication slot 195*b* and the upper insertion opening portion 95*s*, and the lower support part 195*h* will be formed between the lower insertion opening portion 95*t* and the upper communication slot 195*a*.

Also the common opening 95Ub, although not being integrated with the upper communication slot 195*a* and the lower communication slot 195*b* unlike the common opening 95U in the aforementioned embodiments, can highly integrate the flat multi-hole tubes 63 or can downsize the outdoor heat exchanger 11, as a result of combining the upper insertion opening portion 95*s*, the connection slot 95*c*, and the lower insertion opening portion 95*t* into an integrated opening.

(7-4) Modified Example D

Figure 15:
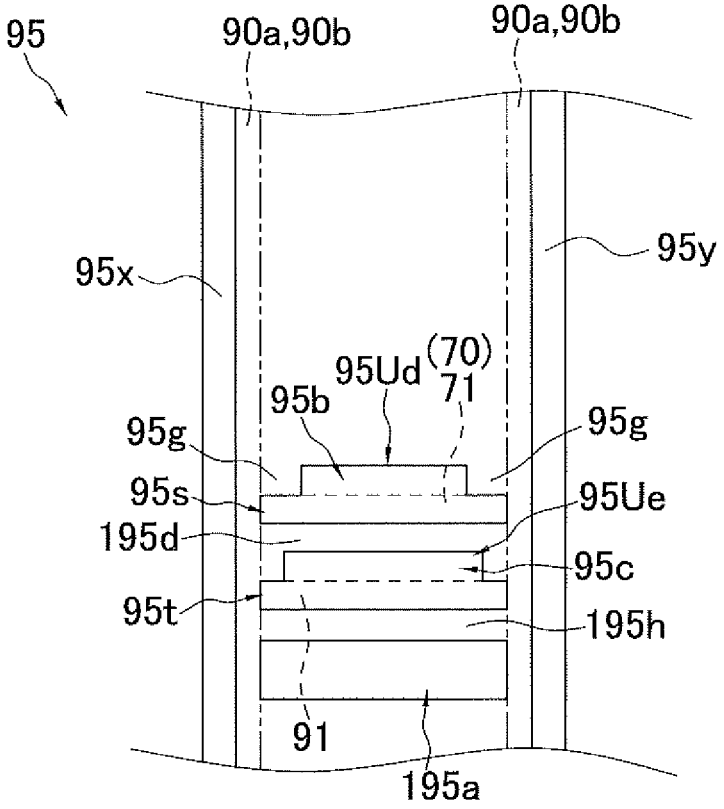
FIG. 15 is a schematic external view, from an insertion direction of the flat multi-hole tube, of a circulation diaphragm of an outdoor heat exchanger according to Modified Example D.

Alternatively as illustrated in FIG. 15, the lower communication slot 95*b* which is an opening through which the refrigerant can circulate in the first upper stage turnaround communication space 90A, and the upper insertion opening portion 95*s* may be contained in a common opening 95Ud as an integrated opening; the connection slot 95*c* and the lower insertion opening portion 95*t* may be contained in a common opening 95Ue as an integrated opening; and the upper communication slot 195*a* which is an opening through which the refrigerant can circulate in the second upper stage turnaround communication space 90B may be provided as a separate opening independent from the common opening 95Ud and from the common opening 95Ue. In this case, an upper support part 195*d* will be formed between the upper insertion opening portion 95*s* and the connection slot 95*c*, and the lower support part 195*h* will be formed between the lower insertion opening portion 95*t* and the upper communication slot 195*a*.

Although the common opening 95Ud and the common opening 95Ue do not have the individual openings all integrated therein, unlike the common opening 95U in the aforementioned embodiments, the common opening 95Ud combines the lower communication slot 95*b* and the upper insertion opening portion 95*s* into an integrated opening, and the common opening 95Ue combines the connection slot 95*c* and the lower insertion opening portion 95*t* into an integrated opening, making it possible to highly integrate the flat multi-hole tubes 63 or to downsize the outdoor heat exchanger 11.

(7-5) Modified Example E

Figure 16:
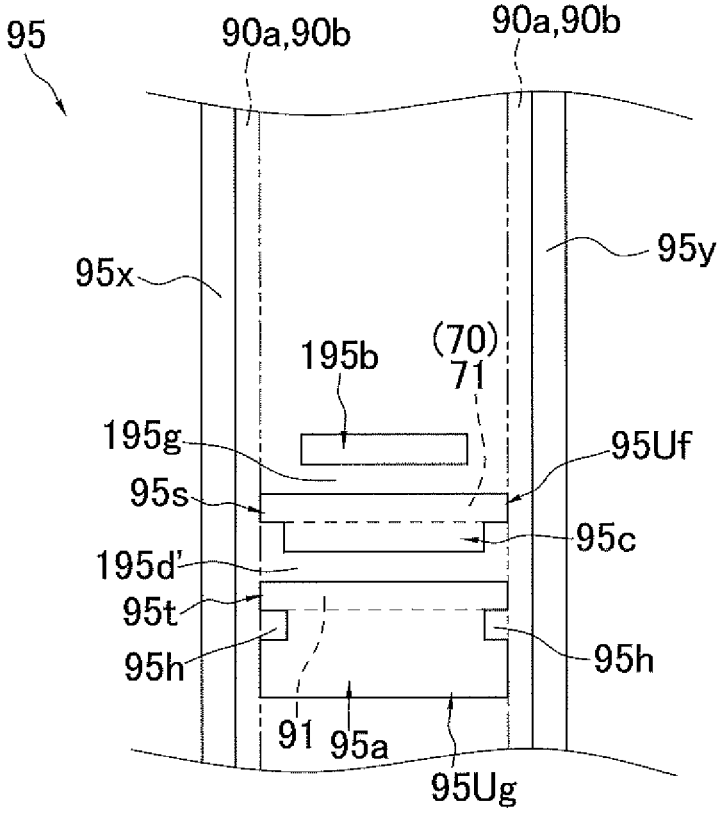
FIG. 16 is a schematic external view, from an insertion direction of the flat multi-hole tube, of a circulation diaphragm of an outdoor heat exchanger according to Modified Example E.

Alternatively as illustrated in FIG. 16, the upper insertion opening portion 95*s* and the connection slot 95*c* may be contained in a common opening 95Uf as an integrated opening; the lower insertion opening portion 95*t* and the upper communication slot 95*a* which is an opening through which the refrigerant can circulate in the second upper stage turnaround communication space 90B may be contained in a common opening 95Ug as an integrated opening; and the lower communication slot 195*b* which is an opening through which the refrigerant can circulate in the first upper stage turnaround communication space 90A may be provided as a separate opening independent from the common opening 95Uf and from the common opening 95Ug. In this case, the top end support part 195*g* will be formed between the lower communication slot 195*b* and the upper insertion opening portion 95*s*, and an upper support part 195*d*' will be formed between the connection slot 95*c* and the lower insertion opening portion 95*t*.

Although the common opening 95Uf and the common opening 95Ug do not have the individual openings all integrated therein, unlike the common opening 95U in the aforementioned embodiments, the common opening 95Uf combines the upper insertion opening portion 95*s* and the connection slot 95*c* into an integrated opening, and the common opening 95Ug combines the lower insertion opening portion 95*t* and the upper communication slot 95*a* into an integrated opening, making it possible to highly integrate the flat multi-hole tubes 63 or to downsize the outdoor heat exchanger 11.

(7-6) Modified Example F

The aforementioned embodiments have been explained, referring to a case where the partially inclined partitioning member with nozzle 70, having the nozzle forming part 71 and the inclined part 72, is composed of an integrated member.

Figure 17:
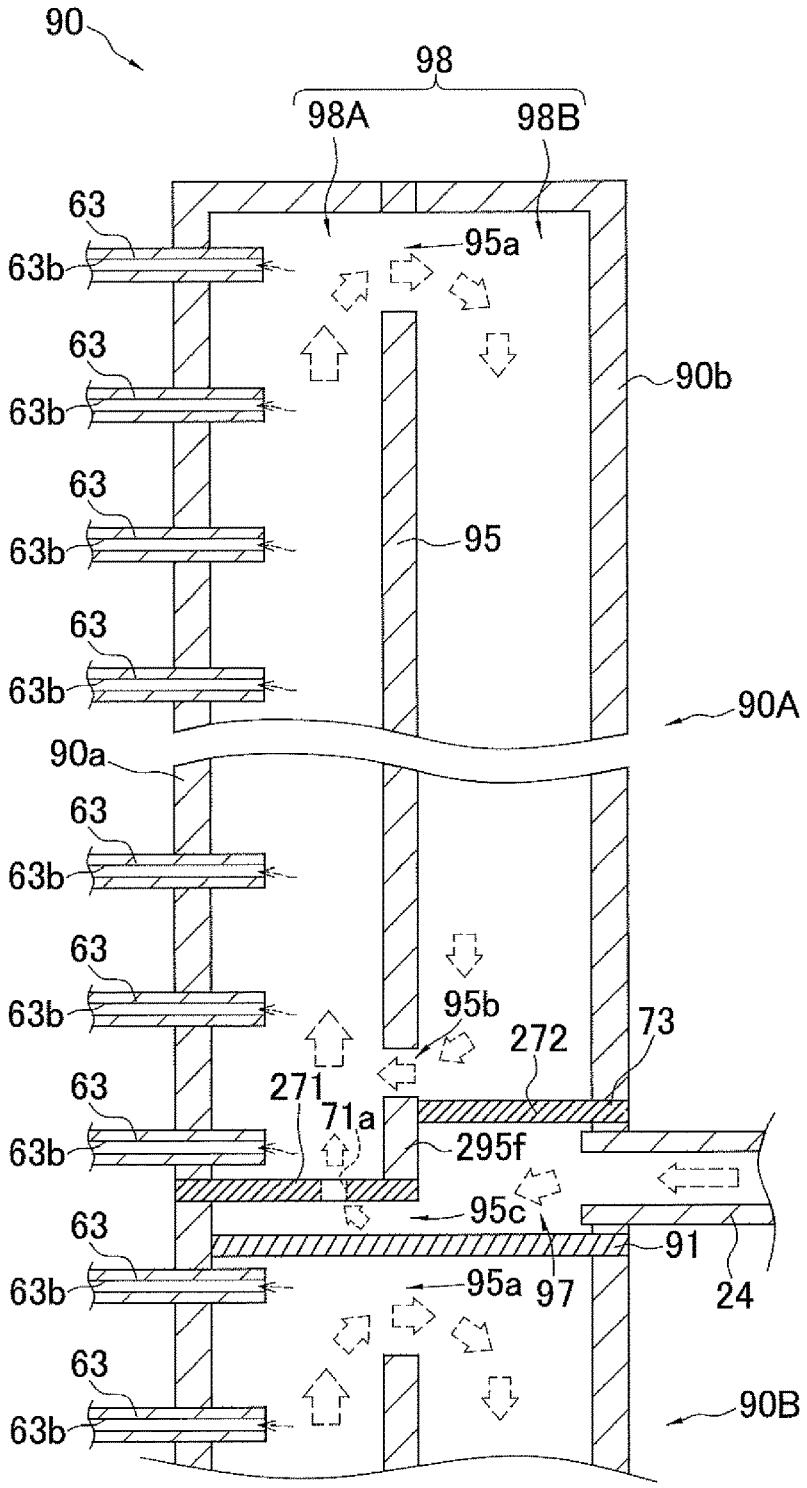
FIG. 17 is a schematic cross-sectional structure diagram, taken along an air flow direction, illustrating an upper end portion of a second header collecting pipe in an outdoor heat exchanger according to Modified Example F.

However, as illustrated in FIG. 17, the partitioning member may alternatively be composed in a separate manner, using a nozzle forming member 271 that is provided so as to compose the bottom face of the upflow space 98A, and a guide member 272 that is provided so as to compose the bottom face of the downflow space 98B at a level higher than the nozzle forming member 271.

Now, an upper connection part 95*f*, which is a part of the circulation diaphragm 95 and composes a portion below the lower communication slot 95*b*, is provided so as to vertically connect a part, on the side opposite to the flat multi-hole tubes 63, of the nozzle forming member 271, and a part, on the side closer to the flat multi-hole tubes 63, of the guide member 272. In such structure, the refrigerant that flows through the first connection pipe 24 into the introduction space 97 is guided towards the zone below the nozzles 71*a* stepwisely, rather than smoothly.

In this structure, a part of the nozzle forming member 271 on the side opposite to the flat multi-hole tubes 63 will be fixed by insertion into the upper insertion opening portion 95*s* of the circulation diaphragm 95. In this structure, the circulation diaphragm 95 will have formed therein an integrated opening that contains the upper insertion opening portion 95*s*, the connection slot 95*c*, the lower insertion opening portion 95*t*, and the upper communication slot 95*a*. Although the lower communication slot 95*b* is not contained unlike the aforementioned embodiments, it also becomes possible to highly integrate the flat multi-hole tubes 63 or to downsize the outdoor heat exchanger 11, as a result of combining the upper insertion opening portion 95*s*, the connection slot 95*c*, the lower insertion opening portion 95*t*, and the upper communication slot 95*a* into an integrated opening.

Such structure, having the nozzle forming member 271 and the guide member 272 connected with the upper connection part 95*f*, is more likely to cause pressure loss, as compared with the partially inclined partitioning member with nozzle 70 in the aforementioned embodiments, since the refrigerant coming through the first connection pipe 24 into the introduction space 97 can strongly collide on the connection part 95*f*. The partially inclined partitioning member with nozzle 70 in the aforementioned embodiments may be able to moderate the collision.

Contrary to the description above, and although not illustrated, for example, the upper end of the introduction space 97 may be composed of a horizontally extending plate-shaped member with the nozzles 71*a* formed therein; and the lower end of the introduction space may be composed of a flat tube-side bottom part that is disposed so as to horizontally extend on the side the flat multi-hole tubes 63 are connected, an opposite-multi-hole tube-side bottom part that is disposed so as to extend horizontally at a level of height lower than the flat tube-side bottom part, and on the side opposite to the side the flat multi-hole tubes 63 are connected, and a lower connection part that is a part of the circulation diaphragm 95, composing an upper part of the upper communication slot 95*a* positioned below the introduction space 97, and vertically connecting a part, on the side opposite to the flat multi-hole tubes 63, of the flat tube-side bottom part, and a part, on the side closer to the flat multi-hole tubes 63, of the opposite-multi-hole tube-side bottom part.

Still alternatively, the introduction space 97 may be formed by all of the nozzle forming member 271, the guide member 272, the upper connection part 95*f*, the flat tube-side bottom part, the opposite-multi-hole tube-side bottom part, and the lower connection part.

(7-7) Modified Example G

The aforementioned embodiments have been explained, referring to a case where the upper end of the introduction space 97 is composed of the partially inclined partitioning member with nozzle 70 having the inclined part 72, and the lower end of the introduction space 97 is composed of the partition plate 91 that extends horizontally.

Figure 18:
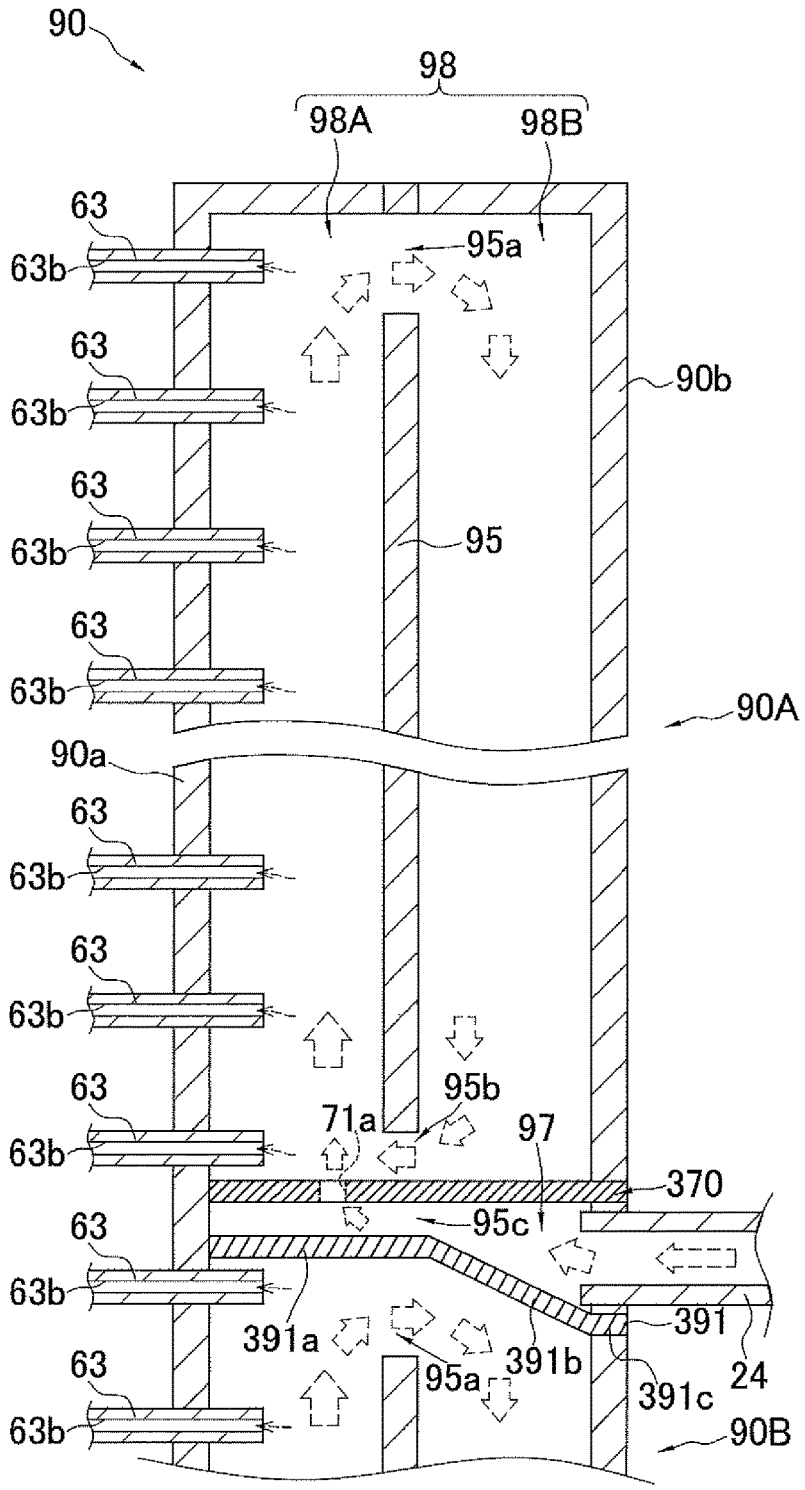
FIG. 18 is a schematic cross-sectional structure diagram, taken along an air flow direction, illustrating an upper end portion of a second header collecting pipe in an outdoor heat exchanger according to Modified Example G.

The introduction space 97 may alternatively be formed, as illustrated in FIG. 18, by a diaphragm with nozzle 370 that has the nozzles 71*a* and extends horizontally so as to compose the upper end of the introduction space 97, and a partially inclined partitioning member 391 that composes the lower end of the introduction space 97.

The partially inclined partitioning member 391 has a horizontal partition part 391*a*, a declined part 391*b*, and a fixable end part 391*c*. The horizontal partition part 391*a* is disposed on the side closer to the flat multi-hole tubes 63 (the side closer to the upflow space 98A) and extends horizontally. The declined part 391*b* protrudes out from the horizontal partition part 391*a* from the side opposite to the flat multi-hole tubes 63, and declines so as to be positioned lower towards the side opposite to the flat multi-hole tubes 63. The fixable end part 391*c* is joined to the declined part 391*b* on the side opposite to the flat multi-hole tubes 63, and is fixed by insertion into a corresponding opening portion provided to the second header structural member 90*b*.

Also this structure, even with the first connection pipe 24 having a large diameter, can demonstrate effects same as those in the aforementioned embodiments.

In this structure, the diaphragm with nozzle 370 will be fixed by insertion into the upper insertion opening portion 95*s* of the circulation diaphragm 95, and a part of the horizontal partition part 391*a* of the partially inclined partitioning member 391, on the side opposite to the flat multi-hole tubes 63, will be fixed by insertion into the lower insertion opening portion 95*t*. Also in such structure, the circulation diaphragm 95 will have formed therein the common opening 95U as an integrated opening that contains the upper insertion opening portion 95*s*, the connection slot 95*c*, the lower insertion opening portion 95*t*, the upper communication slot 95*a*, and the lower communication slot 95*b*, similarly to the aforementioned embodiments.

The structure also makes it possible to guide the refrigerant that comes through the first connection pipe 24 into the introduction space 97 towards a zone just below the nozzles 71*a*, as a result of provision of the declined part 391*b* in an inclined manner, even if the level of height of the lower end of the first connection pipe 24 in the introduction space 97 overlaps the level of height of the flat multi-hole tube 63 positioned just below the horizontal partition part 391*a*, or comes even below the flat multi-hole tube 63 positioned just below the horizontal partition part 391*a*.

The declined part 391*b* of the partially inclined partitioning member 391 is smoothly joined at the end on the side of the flat multi-hole tubes 63 of the declined part 391*b*, to the horizontal partition part 391*a* at the end on the side opposite to the flat multi-hole tubes 63, at the same level of height. Hence, the refrigerant that flows through the upper communication slot 95*a* in the circulation space 98 positioned below the introduction space 97 is less susceptible to transmission resistance.

(7-8) Modified Example H

The aforementioned embodiments have been explained, referring to a case where the upper end of the introduction space 97 is composed of the partially inclined partitioning member with nozzle 70 having the inclined part 72, and the lower end of the introduction space 97 is composed of the partition plate 91 that extends horizontally.

Figure 19:
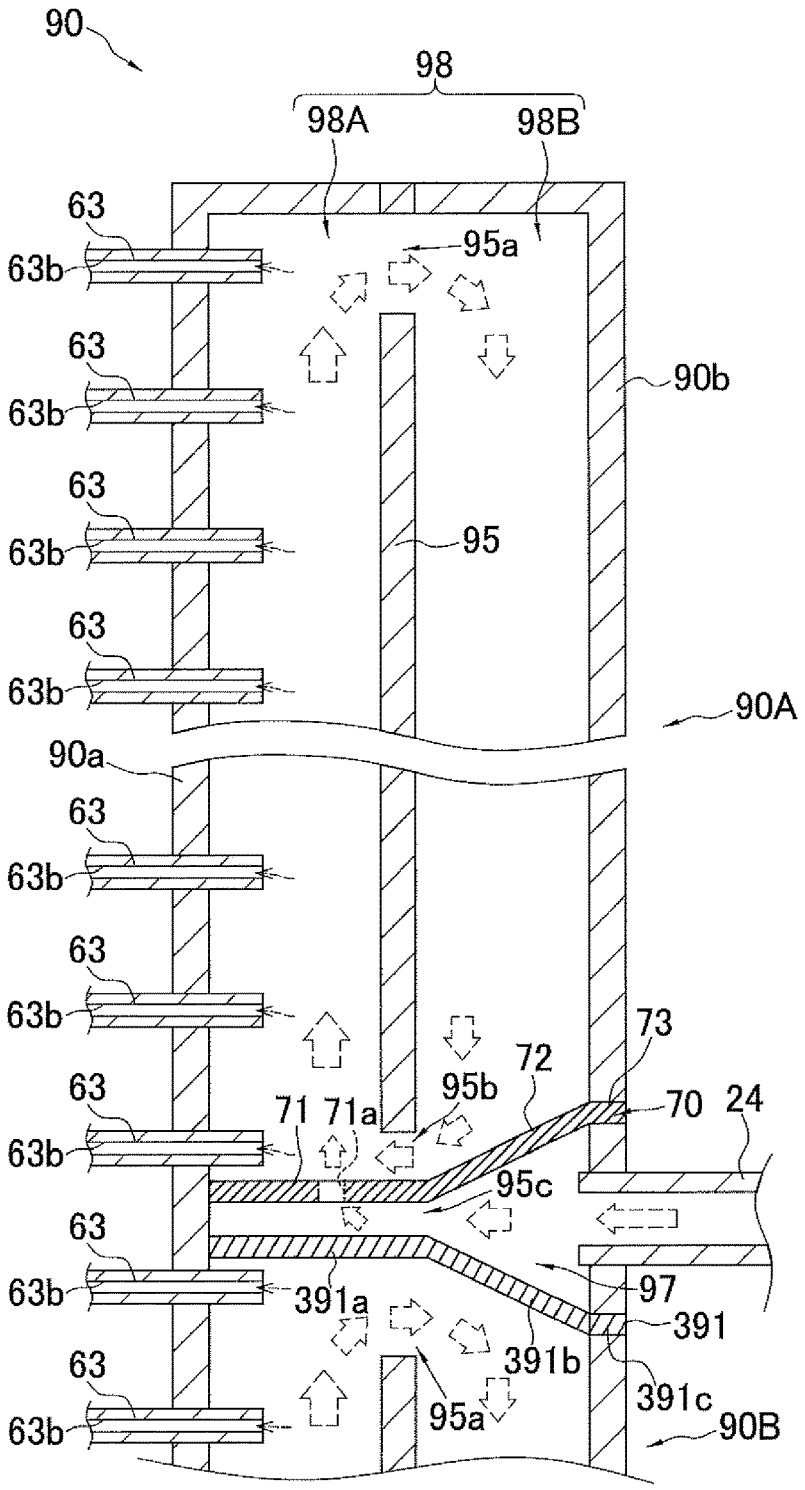
FIG. 19 is a schematic cross-sectional structure diagram, taken along an air flow direction, illustrating an upper end portion of a second header collecting pipe in an outdoor heat exchanger according to Modified Example H.
Figure 20:
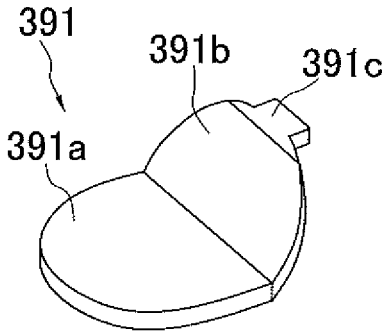
FIG. 20 is a schematic external perspective view of a partially inclined partitioning member.

In contrast, the introduction space 97 may be designed, as illustrated in FIG. 19, by composing the upper end of the introduction space 97 with the partially inclined partitioning member with nozzle 70 which is same as that in the aforementioned embodiments, and by composing the lower end of the introduction space 97 with the partially inclined partitioning member 391 described in Modified Example B, while aligning the axis of the first connection pipe 24 at the center, in the vertical direction, of a zone between the inclined part 72 of the partially inclined partitioning member with nozzle 70 and the declined part 391*b* of the partially inclined partitioning member 391, for example. In this case, manufacturing cost may be reduced by employing the partially inclined partitioning member 391 with a shape illustrated in FIG. 20, which is identical to the partially inclined partitioning member with nozzle 70 except for the absence of the nozzles 71*a*.

In this structure, a part of the nozzle forming part 71 of the partially inclined partitioning member with nozzle 70, on the side opposite to the flat multi-hole tubes 63, is fixed by insertion into the upper insertion opening portion 95*s* of the circulation diaphragm 95, and a part of the horizontal partition part 391*a* of the partially inclined partitioning member 391, on the side opposite to the flat multi-hole tubes 63, is fixed by insertion into the lower insertion opening portion 95*t*, similarly to the aforementioned embodiments. Also in such structure, the circulation diaphragm 95 will have formed therein the common opening 95U as an integrated opening that contains the upper insertion opening portion 95*s*, the connection slot 95*c*, the lower insertion opening portion 95*t*, the upper communication slot 95*a*, and the lower communication slot 95*b*, similarly to the aforementioned embodiments.

In such structure, the inclined part 72 of the partially inclined partitioning member with nozzle 70 extends so as to be positioned higher towards the side opposite to the side the flat multi-hole tubes 63 are connected to the second header collecting pipe 90, and the nozzle forming part 71 is joined to the inclined part 72 at the lowest point, so that it now becomes possible to elevate the upper limit level, in the vertical direction, of the first connection pipe 24 to be connected to the introduction space 97, and to bring down the upper limit level, in the vertical direction, of a zone in the introduction space 97 on the side where the flat multi-hole tubes 63 are connected. In addition, the declined part 391*b* of the partially inclined partitioning member 391 extends so as to be positioned lower towards the side opposite to the side the flat multi-hole tubes 63 are connected to the second header collecting pipe 90, and the horizontal partition part 391*a* is joined to the declined part 391*b* at the highest point, so that it now becomes possible to bring down the lower limit level, in the vertical direction, of the first connection pipe 24 to be connected to the introduction space 97, and to elevate the lower limit level, in the vertical direction, of a zone in the introduction space 97 on the side where the flat multi-hole tubes 63 are connected. Hence, even if the first connection pipe 24 connectable to the introduction space 97 has a large outer diameter (for example, if the outer circumferential width, in the vertical direction, of the first connection pipe 24 is equal to or larger than the vertical distance between the adjacent flat multi-hole tubes 63), it now becomes possible to prevent the flat multi-hole tubes 63, vertically arranged at regular intervals, from being connected to the introduction space 97, or to reduce the number of the flat multi-hole tubes 63 to be connected.

Also, in the introduction space 97, since the center axis of the first connection pipe 24 is aligned at the center, in the vertical direction, of the zone surrounded by the inclined part 72 of the partially inclined partitioning member with nozzle 70 and the declined part 391*b* of the partially inclined partitioning member 391, so that much of the refrigerant introduced through the first connection pipe 24 into the introduction space 97 may be fed into the zone surrounded by the nozzle forming part 71 of the partially inclined partitioning member with nozzle 70 and the horizontal partition part 391*a* of the partially inclined partitioning member 391, while avoiding collision on the inclined part 72 of the partially inclined partitioning member with nozzle 70 and on the declined part 391*b* of the partially inclined partitioning member 391. This successfully reduces pressure loss otherwise possibly caused by the refrigerant flow colliding on the inclined part 72 of the partially inclined partitioning member with nozzle 70 and on the declined part 391*b* of the partially inclined partitioning member 391.

(7-9) Modified Example I

The aforementioned embodiments and Modified Examples have described the exemplary cases where either the top face or the lower face of the introduction space 97 has an inclined part, or has parts disposed at different positions across the longitudinal direction of the second header collecting pipe 90, such as the partially inclined partitioning member with nozzle 70 having the inclined part 72; the nozzle forming member 271 and the guide member 272 which are disposed at different positions across the longitudinal direction of the second header collecting pipe 90; and the partially inclined partitioning member 391 having the declined part 391*b*.

Figure 21:
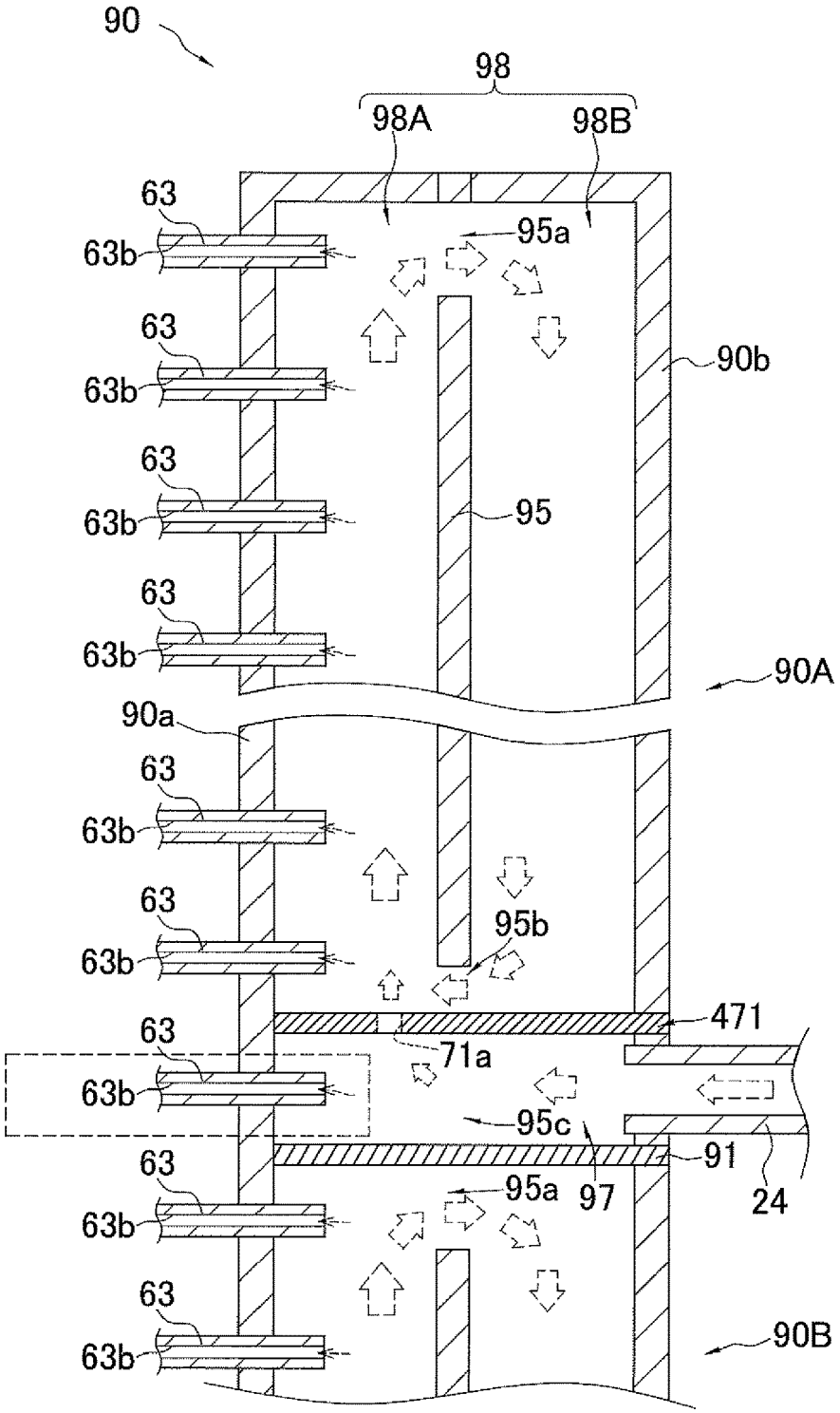
FIG. 21 is a schematic cross-sectional structure diagram, taken along an air flow direction, illustrating an upper end portion of a second header collecting pipe in an outdoor heat exchanger according to Modified Example I.

In contrast, members that compose one side and the other side of the introduction space 97, across the longitudinal direction of the second header collecting pipe 90, are not limited to those having such inclined part or those disposed at different positions across the longitudinal direction of the second header collecting pipe 90, but instead may be those composed of flat faces that extend perpendicularly to the longitudinal direction of the second header collecting pipe 90, such as a diaphragm with nozzle 471 and the partition plate 91, typically as illustrated in FIG. 21, for example.

Also the structure, having the introduction space 97 composed of the diaphragm with nozzle 471 and the partition plate 91 as described above, can enjoy the effects of employment of the common opening 95U, similarly as described in the aforementioned embodiments.

Such structure may alternatively employ the flat multi-hole tube 63 to be also connected to the introduction space 97, so as to avoid decline of performance of the outdoor heat exchanger 11 due to cutback of the flat multi-hole tubes 63, or so as to dispose the flat multi-hole tubes 63 at regular intervals in the vertical direction. Note that since the structure causes pressure loss at the nozzles 71*a* of the diaphragm with nozzle 471, and thus creates difference in pressure between the upstream side and the downstream side of the nozzles 71*a*, the flat multi-hole tube 63 connected to the introduction space 97 (a flat multi-hole tube 63 surrounded by a broken line in FIG. 21) will have a larger volume of refrigerant rushed thereinto in a concentrated manner, as compared with the flat multi-hole tubes 63 connected to the circulation space 98 above the diaphragm with nozzle 471, with a suspected risk of causing drift of refrigerant among the plurality of flat multi-hole tubes 63. In this point of view, the aforementioned embodiments may have no flat multi-hole tube 63 connected to the introduction space 97.

(7-10) Modified Example J

The aforementioned embodiments have been explained referring to the structure of the outdoor heat exchanger 11 used as an evaporator, in which the refrigerant after flowing through the lower stage heat exchanging unit 60B on the lower stage side and before being fed into the upper stage heat exchanging unit 60A on the upper stage is distributed into the flat multi-hole tubes 63 at the individual levels of height (first upper stage turnaround communication space 90A, second upper stage turnaround communication space 90B, and third upper stage turnaround communication space 90C), while blowing up the refrigerant through the nozzles 71*a*.

The embodiments, however, do not limit a site in the outdoor heat exchanger 11, capable of employing such structure, in which the refrigerant is blown up through the nozzles 71*a* to be distributed into the flat multi-hole tubes 63 connected at the individual levels of height.

Figure 22:
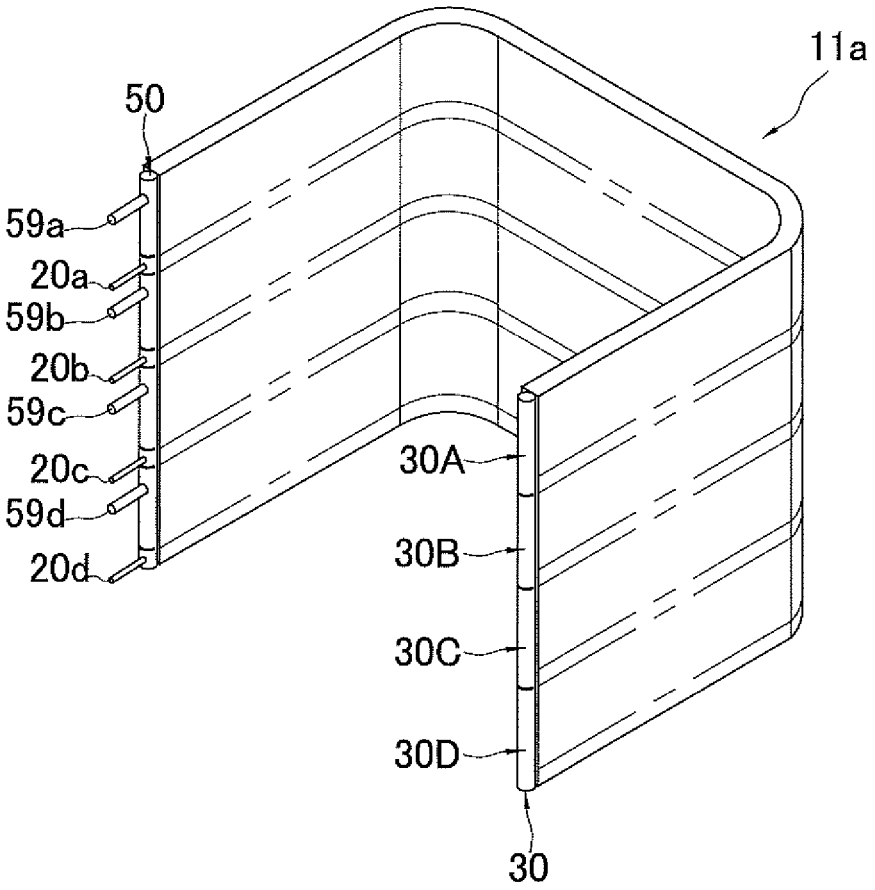
FIG. 22 is a schematic perspective view of an outdoor heat exchanger according to Modified Example J.
Figure 23:
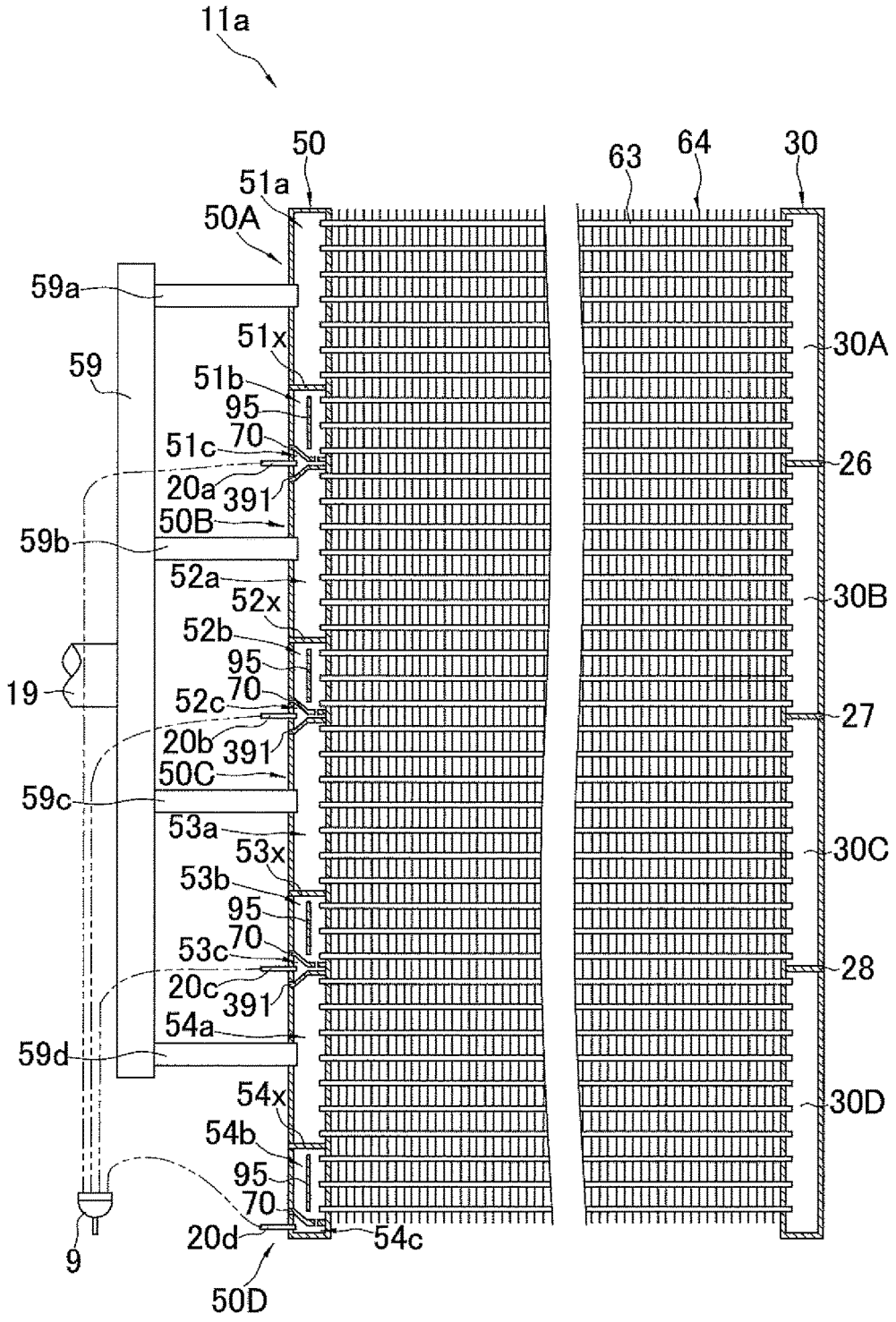
FIG. 23 is a structure diagram explaining refrigerant flow in the outdoor heat exchanger according to Modified Example J.

For example as illustrated in FIGS. 22 and 23, in an outdoor heat exchanger 11*a* in which a header collecting pipe 50 and a turnaround header 30, both being erected, are connected by the plurality of flat multi-hole tubes 63 vertically juxtaposed, the refrigerant after divided by a flow divider 9 may be introduced through individual branch pipes 20*a* to 20*d* into individual introduction spaces 51*c* to 54*c* in the header collecting pipe 50, and in these sites, the refrigerant may be divided into the flat multi-hole tubes 63 at the individual levels of height while being blown up through the nozzles.

The inside of the header collecting pipe 50 of the outdoor heat exchanger 11*a* is divided for every path of the refrigerant flow, and more specifically into first to fourth divisional flow spaces 50A to 50D, in that order from the top to the bottom. The first to fourth divisional flow spaces 50A to 50D are vertically partitioned by the partially inclined partitioning member 391 having no nozzle formed therein, which is same as that in the aforementioned embodiments. Also the inside of the turnaround header 30 of the outdoor heat exchanger 11*a* is divided for every path of the refrigerant flow, into first to fourth turnaround spaces 30A to 30D, in that order from the top to the bottom, corresponding respectively to the first to fourth divisional flow spaces 50A to 50D of the header collecting pipe 50. The first to fourth turnaround spaces 30A to 30D are vertically partitioned by partition plates 26, 27, 28 having formed therein no opening or the like.

In the first divisional flow space 50A of the header collecting pipe 50, further disposed are an upper space 51*a*, a circulation space 51*b*, and an introduction space 51*c* which are juxtaposed in that order from the top to the bottom. The upper space 51*a* and the circulation space 51*b* are partitioned by a partition plate 51*x* in the vertical direction. The circulation space 51*b* and the introduction space 51*c* are divided in the vertical direction, by the partially inclined partitioning member with nozzle 70 same as that in the aforementioned embodiments. The inside of the circulation space 51*b* is same as that in the aforementioned embodiments, in that the structure has the circulation diaphragm 95, and can circulate the refrigerant. Features regarding that the lower end of the introduction space 97 is composed of the partially inclined partitioning member 391, and that the upper end of the introduction space 97 is composed of the partially inclined partitioning member with nozzle 70, are same as those in Modified Example C.

The inside of the second divisional flow space 50B of the header collecting pipe 50 is same as that in the first divisional flow space 50A, in which an upper space 52*a*, a circulation space 52*b*, and an introduction space 52*c* are juxtaposed in that order from the top to the bottom. The upper space 52*a* and the circulation space 52*b* are partitioned by a partition plate 52*x* in the vertical direction, and the circulation space 52*b* and the introduction space 52*c* are partitioned by the partially inclined partitioning member with nozzle 70 in the vertical direction.

The inside of the third divisional flow space 50C of the header collecting pipe 50 is same as that in the first divisional flow space 50A, in which an upper space 53*a*, a circulation space 53*b*, and an introduction space 53*c* are juxtaposed in that order from the top to the bottom. The upper space 53*a* and the circulation space 53*b* are partitioned by a partition plate 51*x* in the vertical direction, and the circulation space 53*b* and the introduction space 53*c* are partitioned by the partially inclined partitioning member with nozzle 70 in the vertical direction.

In the inside of the fourth divisional flow space 50D of the header collecting pipe 50, an upper space 54*a*, a circulation space 54*b*, and an introduction space 54*c* are juxtaposed in that order from the top to the bottom. The upper space 54*a* and the circulation space 54*b* are partitioned by a partition plate 54*x* in the vertical direction, and the circulation space 54*b* and the introduction space 54*c* are partitioned by the partially inclined partitioning member with nozzle 70 in the vertical direction. The lower end of the introduction space 54*c* in the fourth divisional flow space 50D is composed of an end part of the header collecting pipe 50.

In the header collecting pipe 50, protruded are a confluence pipe 59*a* from the upper space 51*a* of the first divisional flow space 50A, a confluence pipe 59*b* from the upper space 52*a* of the second divisional flow space 50B, a confluence pipe 59*c* from the upper space 53*a* of the third divisional flow space 50C, and a confluence pipe 59*d* from the upper space 54*a* of the fourth divisional flow space 50D, all pipes being connected to a confluence part 59 from which the refrigerant pipe 19 extends.

When the outdoor heat exchanger 11*a* is used as an evaporator of refrigerant, the refrigerant divided by the flow divider 9 flows through the individual branch pipes 20*a* to 20*d* into the individual introduction spaces 51*c* to 54*c* in the header collecting pipe 50. The refrigerant is then blown up through the nozzles of the partially inclined partitioning members with nozzles 70 in the individual introduction spaces 51*c* to 54*c* into the circulation spaces 51*b* to 54*b*, and then distributed into the plurality of flat multi-hole tube 63 connected to the individual circulation spaces 51*b* to 54*b*, while ascending and circulating in the circulation spaces 51*b* to 54*b*. The refrigerant having flowed to the other ends of the flat multi-hole tubes 63 to reach the turnaround header 30 then enters the plurality of flat multi-hole tubes 63 that are connected at higher positions, and flows again towards the header collecting pipe 50. The refrigerant that has reached the individual upper spaces 51*a* to 54*a* of the header collecting pipe 50 then flows through the individual confluence pipes 59*a* to 59*d* into the confluence part 59, and then flows towards the refrigerant pipe 19. For the outdoor heat exchanger 11*a* used as a condenser, the aforementioned flow will be inverted overall.

Also the thus structured outdoor heat exchanger 11*a* can demonstrate effects same as those described in the aforementioned embodiments and the individual Modified Examples described above.

(7-11) Modified Example K

The aforementioned embodiments have been explained referring to the case where the flat multi-hole tube 63 is not connected to the introduction space 97.

In contrast, acceptable is a structure in which the flat multi-hole tube 63 is connected to the introduction space 97. Even in this case, since the vertical width of the introduction space 97 is successfully made narrower on the side closer to the nozzles 71*a*, than on the side the first connection pipe 24 is connected, so that the number of flat multi-hole tubes 63 to be connected to the introduction space 97 may be reduced. Hence, it now becomes possible to reduce the number of flat multi-hole tubes 63 where the refrigerant, before passing through the nozzles 71*a* in the introduction space 97, with a relative high pressure, can enter, and thereby the drift of refrigerant among the plurality of flat multi-hole tubes 63 may be minimized as low as possible.

Having described the embodiments and modifications of the present inventions, it would be understood that a variety of modifications will be made on the morphology or other details, without departing from the spirit and scope described in claims.

REFERENCE SIGNS LIST

1 Air conditioner
2 Outdoor unit
11, 11*a* Outdoor heat exchanger (heat exchanger)
20*a* to 20*d* Branch pipe (refrigerant pipe)
24 First connection pipe (refrigerant pipe)
25 Second connection pipe (refrigerant pipe)
50 Header collecting pipe (header)
51*a* to 54*a* Upper space
51*b* to 54*b* Circulation space
51*c* to 54*c* Introduction space
63 Flat multi-hole tube (flat tube)
63*a* Flat face
64 Fin
70 Partially inclined partitioning member with nozzle (second partitioning member, first side member)
71 Nozzle forming part
71*a* Nozzle
72 Inclined part
90 Second header collecting pipe (header)
90*a* First header structural member
90*b* Second header structural member
91 Partition plate (second partitioning member, second side member)
92 Partition plate (second partitioning member, second side member)
95 Circulation diaphragm (first partitioning member)
95*a* Upper communication slot (second circulation opening portion)
95*b* Lower communication slot (first circulation opening portion)
95*c* Connection slot (refrigerant opening portion)
95*d* Upper support projection (shape capable of positioning second partitioning member)
95*g* Top end support part
95*h* Lower support projection
95*s* Upper insertion opening portion (first side insertion opening portion, insertion opening portion)
95*t* Lower insertion opening portion (second side insertion opening portion, insertion opening portion)
95U Common opening
95Ua to 95Ug Common opening
97 Introduction space (space surrounded by first side member and second side member)
98 Circulation space (upper space, upper space)
98A Upflow space (flat tube-side space)
98B Downflow space (opposite-flat tube-side space)
295*f* Connection part
271 Nozzle forming member (second partitioning member, first side member)
272 Guide member
370 Diaphragm with nozzle (second partitioning member, first side member)
391 Partially inclined partitioning member (second partitioning member, second side member)
391*b* Declined part
471 Diaphragm with nozzle (second partitioning member, first side member)

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

The invention claimed is:

1. A heat exchanger comprising:

a header;

flat tubes connected to the header and disposed in line along a longitudinal direction of the header;

a first partition that partitions an inner space of the header into a first space on a side where the flat tubes are connected and a second space on a side opposite to the first space; and a second partition that partitions the inner space of the header into a first side and a second side, wherein the first side is one side of the header in the longitudinal direction and the second side is opposite to the first side, the first partition is a single plate that has a common opening disposed between outside edges of the first partition and that supports the second partition at the common opening, the common opening comprises an insertion opening and a refrigerant opening, a refrigerant moves between the first space and the second space via the refrigerant opening, and the second partition is inserted into and passes through the insertion opening, the second partition comprises:

a first side member that partitions the inner space across the longitudinal direction into a first side relative to the first side member and a second side relative to the first side member and that is disposed on a first side of the refrigerant opening; and a second side member that partitions the inner space across the longitudinal direction into a first side relative to the second side member and a second side relative to the second side member and that is disposed on a second side of the refrigerant opening, the common opening further comprises, as the insertion opening, a first side insertion opening and a second side insertion opening, the first side member is disposed into the first side insertion opening, and the second side member is disposed into the second side insertion opening.

2. The heat exchanger according to claim 1, wherein the common opening comprises an outline that conforms to a shape that positions the second partition across the longitudinal direction of the header.

3. The heat exchanger according to claim 1, wherein the flat tubes are not connected to a space, in the inner space of the header, surrounded by the first side member and the second side member, and the refrigerant opening is between the first side member and the second side member.

4. The heat exchanger according to claim 1, wherein the first side member comprises, in the first space or the second space, a nozzle that extends through the first side member in the longitudinal direction of the header.

5. The heat exchanger according to claim 1, further comprising:

a refrigerant pipe connected to the second space in a space, in the inner space of the header, surrounded by the first side member and the second side member, wherein the first side member comprises, in the first space, a nozzle that extends through the first side member in the longitudinal direction of the header.

6. The heat exchanger according to claim 4, wherein the first partition comprises:

a first circulation opening through which the first space and the second space are connected on the first side relative to the first side member; and a second circulation opening through which the first space and the second space are connected on a first side of the first circulation opening in the longitudinal direction of the header, and the common opening further comprises the first circulation opening.

7. The heat exchanger according to claim 4, wherein the first partition comprises:

a first circulation opening through which the first space and the second space are connected on the first side relative to the first side member; and a second circulation opening through which the first space and the second space are connected on a first side of the first circulation opening in the longitudinal direction of the header, structures each comprising a set of the first circulation opening, the second circulation opening, the refrigerant opening, the first side insertion opening, the second side insertion opening, the first side member, and the second side member are repeatedly juxtaposed in the longitudinal direction of the header, and the common opening comprises:

the refrigerant opening, the first side insertion opening, and the second side insertion opening of a first set; and the second circulation opening of a second set disposed on a second side of the first set.

8. The heat exchanger according to claim 4, wherein the first partition comprises:

a first circulation opening through which the first space and the second space are connected on the first side relative to the first side member; and a second circulation opening through which the first space and the second space are connected on a first side of the first circulation opening in the longitudinal direction of the header, structures each comprising a set of the first circulation opening, the second circulation opening, the refrigerant opening, the first side insertion opening, the second side insertion opening, the first side member, and the second side member are repeatedly juxtaposed in the longitudinal direction of the header, and the common opening comprises:

the refrigerant opening, the first side insertion opening, the second side insertion opening, and the first circulation opening of a first set; and the second circulation opening of a second set positioned on a second side of the first set.

9. The heat exchanger according to claim 6, wherein an aperture area of the second circulation opening is larger than an aperture area of the first circulation opening.

10. The heat exchanger according to claim 6, wherein the nozzle is disposed at a position that does not overlap, when viewed in the longitudinal direction of the header, a virtual space defined by extending the first circulation opening in a direction the flat tubes extend.

11. The heat exchanger according to claim 4, wherein the nozzle is disposed 1 mm or more away from an inner circumferential face of the header and away from the first partition.

12. The heat exchanger according to claim 1, wherein the longitudinal direction of the header lies in a vertical direction of the heat exchanger.

13. An air conditioner comprising: the heat exchanger according to claim 1.

* * * * *